US009381762B2

(12) United States Patent
Yoshida

(10) Patent No.: US 9,381,762 B2
(45) Date of Patent: Jul. 5, 2016

(54) CONTROL DEVICE

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/722,804

(22) Filed: May 27, 2015

(65) Prior Publication Data

US 2015/0343818 A1 Dec. 3, 2015

(30) Foreign Application Priority Data

May 30, 2014 (JP) ..... 2014-113238

(51) Int. Cl.
*B41J 29/38* (2006.01)

(52) U.S. Cl.
CPC ..... *B41J 29/38* (2013.01)

(58) Field of Classification Search
CPC ..... B41J 29/38
USPC ..... 347/9
See application file for complete search history.

(56) References Cited

U.S. PATENT DOCUMENTS 6,511,144 B2 * 1/2003 Otsuki ..... B41J 11/06 347/104

FOREIGN PATENT DOCUMENTS

| | | | |
|---|---|---|---|
| JP | 2005-271231 | A | 10/2005 |
| JP | 2006-044060 | A | 2/2006 |
| JP | 2011-126124 | A | 6/2011 |

* cited by examiner

*Primary Examiner* — Stephen Meier
*Assistant Examiner* — Alexander D Shenderov
(74) *Attorney, Agent, or Firm* — Merchant & Gould P.C.

(57) ABSTRACT

A control device may create and supply print data. The print data may include first edge print data and first central print data. The first edge print data may include data for causing a print performing unit to perform printing which satisfies: a print medium is transported along a first direction by a first transportation amount; a first type of main-scanning action is performed; a number of nozzles of a usage nozzle group is maintained to n; and the usage nozzle group is shifted toward an upstream side along the first direction. The first central print data may include data for causing the print performing unit to perform printing which satisfies: the print medium is transported along the first direction by a second transportation amount; a second type of main-scanning action is performed; and the number of nozzles of the usage nozzle group is maintained to n.

14 Claims, 15 Drawing Sheets

(Comparison Embodiment)

(Second Embodiment)

(Third Embodiment)

Transportation Amount of TJ (TJ amount)
= n·D

Transportation Amount of TI
= TJ amount − NS

Transportation Amount of TK
= TJ amount − NS (Fourth Embodiment)

Transportation Amount of TM
(TM amount)
= n·D

Transportation Amount of TL
= TM amount − NS (Fourth Embodiment)

(Fifth Embodiment)

CONTROL DEVICE

CROSS-REFERENCE TO RELATED APPLICATION

This application claims priority to Japanese Patent Application No. 2014-113238, filed on May 30, 2014, the contents of which are hereby incorporated by reference into the present application.

TECHNICAL FIELD

The present description discloses a control device configured to cause a print performing unit to perform printing.

DESCRIPTION OF RELATED ART

An ink jet type printer is widely known. In this type of printer, an print medium is sequentially transported in a sub-scanning direction from an upstream side to a downstream side by a plurality of times, and a main-scanning action of a printing head is performed when each transporting movement is completed. In the main-scanning action, the printing head discharges ink toward the print medium while the printing head moves along a main-scanning direction.

For example, a following technique is known: in a section from a $1^{st}$ scan, where the printing is started, to $11^{th}$ scan, a sheet is transported by ⅛ of a length of a recording element string. Then, an enlargement of a range of usage recording elements is started from $12^{th}$ scan, and a transportation amount of the sheet is increased. That is, in this technique, printing at an edge of the sheet is set with smaller sheet transportation amount, and a number of the usage recording elements becomes less, compared to printing at a center of the sheet.

SUMMARY

In the above technique, printing takes long time, due to smaller sheet transportation amount being set and the number of the usage recording elements being smaller in the printing at the edge of the sheet. More specifically, printing time per unit area of the edge of the sheet becomes longer than printing time per unit area of the center of the sheet. In the present description, a technique is provided for performing printing promptly, even in a case where a transportation amount for printing at an edge area on a print medium is set small.

A control device may be configured to cause a print performing unit to perform printing. The p6rint performing unit may comprise: a printing head comprising N nozzles which align along a first direction, the N being an integer equal to or more than 2; a medium transportation unit configured to transport a print medium from an upstream side to a downstream side along the first direction; and a head driving unit configured to cause the printing head to perform a main-scanning action, the main-scanning action including an action for causing the printing head to discharge ink toward the print medium while causing the printing head to move along a second direction which is perpendicular to the first direction. The control device may comprise: a processor; and a memory storing computer-readable instructions which, when performed by the processor, cause the control device to: obtain image data representing a target image; create print data using the image data, the print data being for causing the print performing unit to perform printing of the target image on the print medium in accordance with a predetermined print resolution; and supply the print data to the print performing unit. The print data may include first edge print data and first central print data, the first edge print data being for causing the print performing unit to form a first edge image which is a part of the target image on a first edge area being located at an edge of the print medium along the first direction, the first central print data being for causing the print performing unit to form a first central image which is another part of the target image on a first central area being located at a center of the print medium along the first direction. The first edge print data may include data for causing the print performing unit to perform printing which satisfies following conditions: (A1) the medium transportation unit sequentially transports the print medium M1 times along the first direction by a first transportation amount, the M1 being an integer equal to or more than 2, and the first transportation amount being less than a standard transportation amount; (A2) the head driving unit causes the printing head to perform a first type of main-scanning action each time the transportation of the print medium by the first transportation amount is completed; (A3) in M1 times of the first type of main-scanning actions, each of which is performed each time the transportation of the print medium by the first transportation amount is completed, a number of nozzles of a usage nozzle group is maintained to n among the N, the n being an integer satisfying $1 \leq n < N$, and the usage nozzle group being a group of nozzles that is permitted to be used; and (A4) in the M1 times of the first type of main-scanning actions, the usage nozzle group used in the first type of main-scanning action for an m1-th time is shifted toward an upstream side along the first direction, compared to the usage nozzle group used in the first type of main-scanning action for an (m1−1)-th time, the m1 being each integer satisfying $2 \leq m1 \leq M1$. The first central print data may include data for causing the print performing unit to perform printing which satisfies following conditions: (B1) the medium transportation unit sequentially transports the print medium M2 times along the first direction by a second transportation amount, the M2 being an integer equal to or more than 2, and the second transportation amount being equal to or greater than the standard transportation amount; (B2) the head driving unit causes the printing head to perform a second type of main-scanning action each time the transportation of the print medium by the second transportation amount is completed; and (B3) in M2 times of the second type of main-scanning actions, each of which is performed each time the transportation of the print medium by the second transportation amount is completed, the number of nozzles of the usage nozzle group is maintained to the n among the N. The standard transportation amount may be a transportation amount which realizes printing in accordance with the predetermined print resolution by a plurality of main-scanning actions, in a state where the print medium is transported by a constant transportation amount, the number of nozzles of the usage nozzle group is maintained to the n among the N, and the usage nozzle group is not shifted.

A printer comprising the aforementioned print performing unit, the processor, and the memory is also novel and useful. A system comprising the aforementioned print performing unit and the control device is also novel and useful. Further, a control method, computer-readable instructions for implementation of the control device, and a non-transitory computer-readable recording medium in which the computer-readable instructions are stored, are also novel and useful.

EMBODIMENTS

Figure 1:
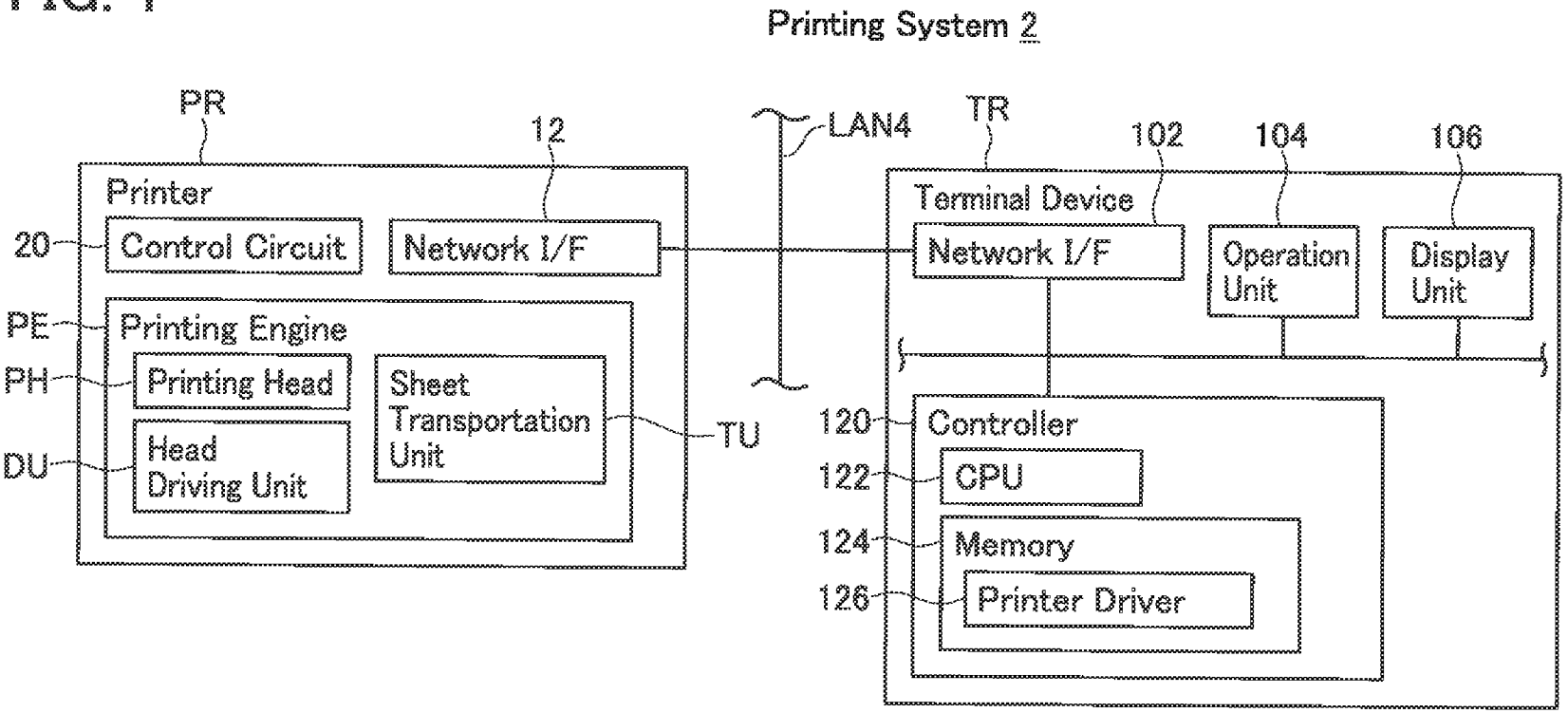
FIG. 1 shows a configuration of a printing system.

First Embodiment (Configuration of Printing System 2; FIG. 1)

As shown in FIG. 1, a printing system 2 comprises a printer PR and a terminal device TR. The printer PR and the terminal device TR are communicable with each other via a LAN 4.

(Configuration of Printer PR)

The printer PR comprises a network interface 12, a control circuit 20, and a printing engine PE. The network interface 12 is connected to the LAN 4. The control circuit 20 comprises a CPU and a memory that are not shown, and is configured to perform various processes for causing the printing engine PE to perform printing. The printing engine PE comprises a printing head PH, a sheet transportation unit TU, and a head driving unit DU.

Figure 2:
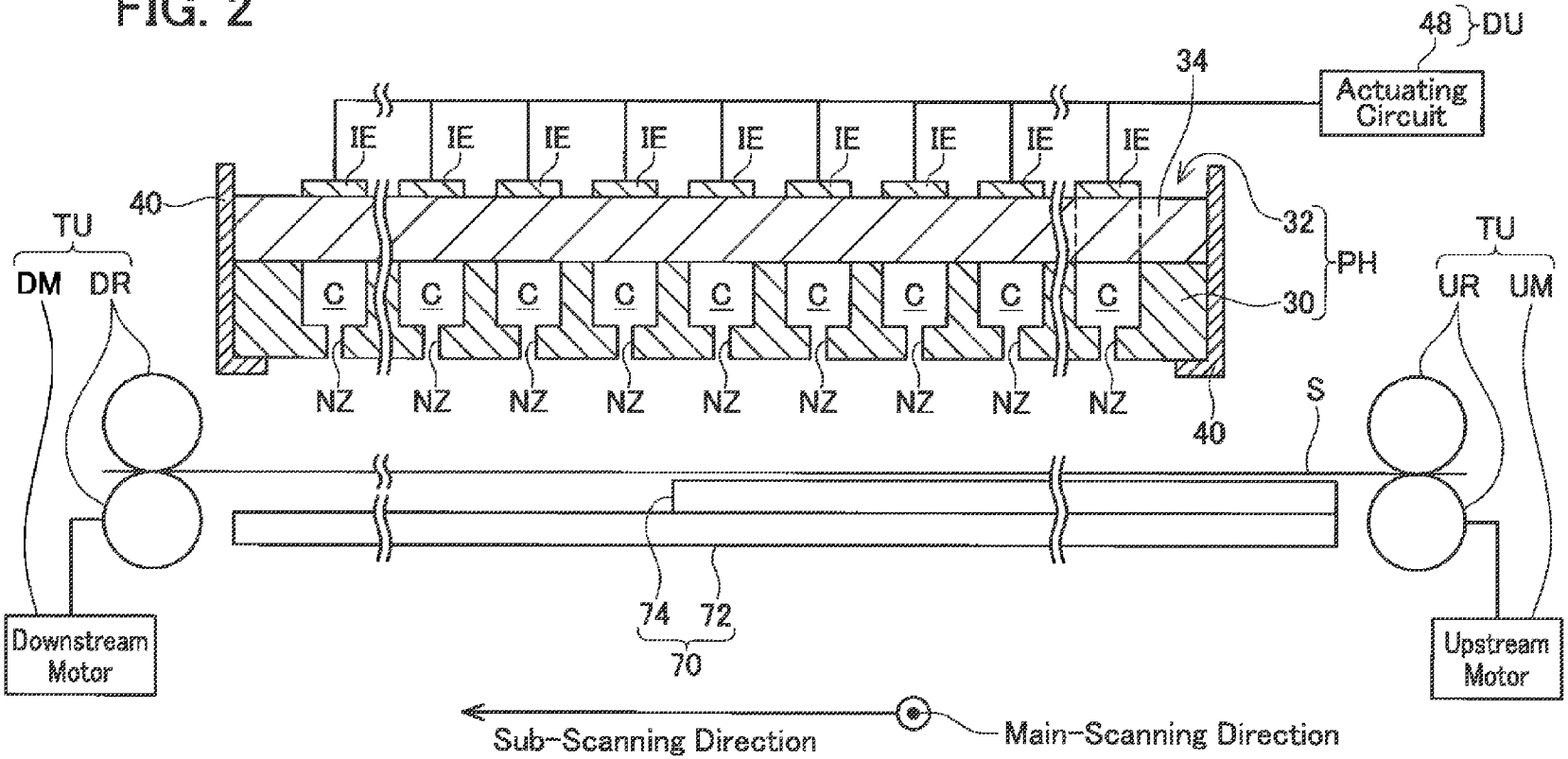
FIG. 2 shows a configuration of a part of a printing engine.
Figure 3:
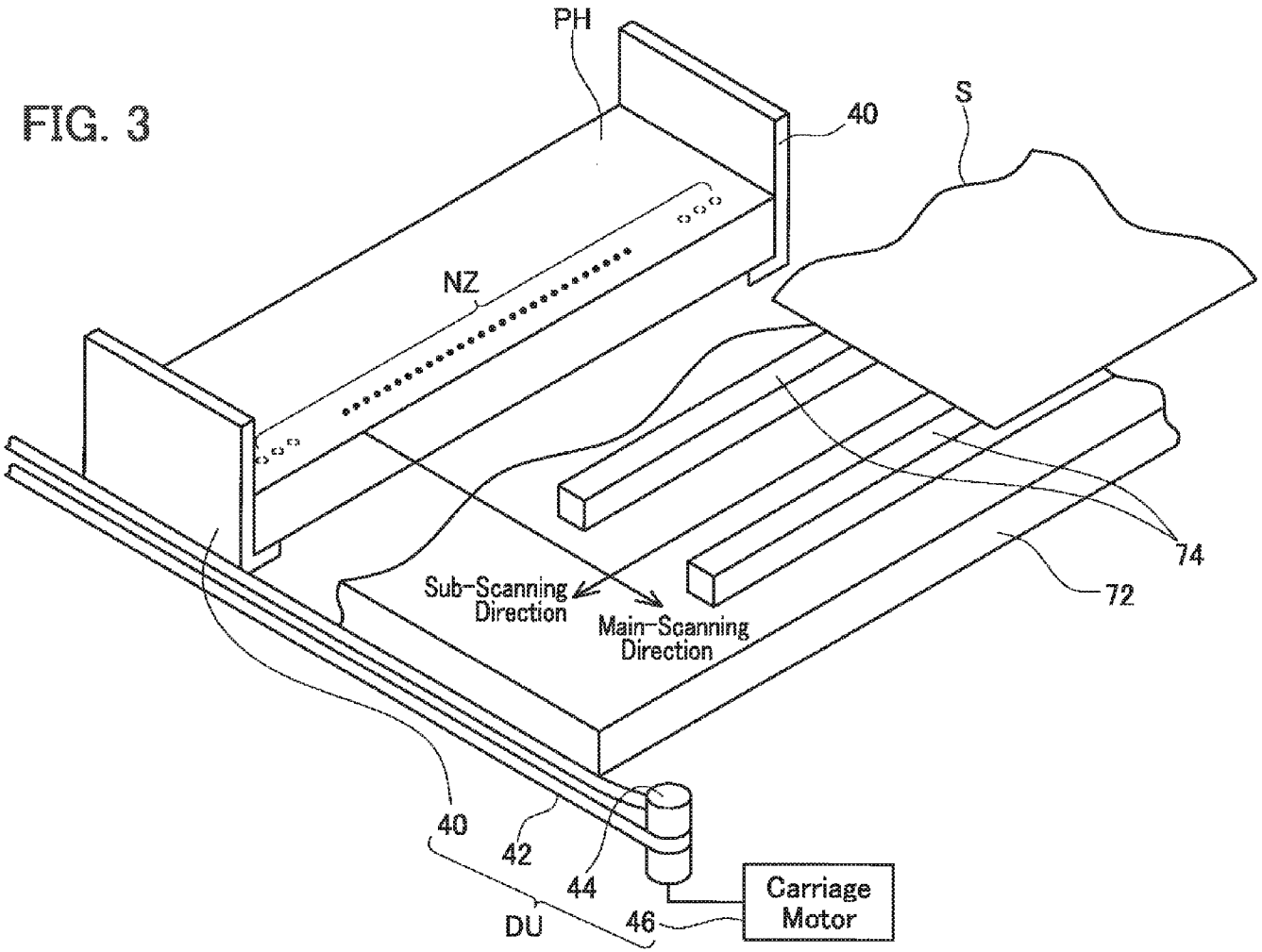
FIG. 3 shows a perspective view of a part of the printing engine.

(Configuration of Printing Engine PE; FIG. 2, FIG. 3)

FIG. 2 shows a configuration of a part of the printing engine PE. In FIG. 2, a direction vertical to a viewed plane of the diagram, which is a direction along which the printing head PH is to move upon when printing onto a sheet S is performed, is a main-scanning direction, and a leftward direction, which is a direction along which the sheet S is to move upon when the printing onto the sheet S is performed, is a sub-scanning direction. The sheet transportation unit TU comprises an upstream roller pair UR, an upstream motor UM that drives one of the rollers of the upstream roller pair UR, a downstream roller pair DR, and a downstream motor DM that drives one of the rollers of the downstream roller pair DR. Notably, in FIG. 2, one upstream roller pair UR and one downstream roller pair DR are depicted. However, in actuality, a plurality of upstream roller pairs UR and a plurality of downstream roller pairs DR are aligned in the direction vertical to the viewed plane of FIG. 2. Each of the upstream roller pairs UR and the downstream roller pairs DR transports the sheet S in the leftward direction (that is, sub-scanning direction) of FIG. 2. The upstream roller pairs UR and the downstream roller pairs DR are respectively arranged on an upstream side (that is, right side in FIG. 2) and a downstream side (that is, left side in FIG. 2) than the printing head PH in the sub-scanning direction. The upstream roller pairs UR transport the sheet S toward the downstream roller pairs DR. The downstream roller pairs DR transport the sheet S that had been transported by the upstream roller pairs UR toward a sheet feed-out tray that is not shown.

The printing head PH comprises an ink passage unit 30 and an actuator unit 32. A plurality of nozzles NZ for discharging ink droplets of black (K) ink is formed on a lower surface of the ink passage unit 30. A total number of the nozzles NZ may for example be 400 or more, and hereinbelow referred to as "N (where N is an integer of 2 or more)". The N pieces of nozzles NZ are aligned in a straight line along the sub-scanning direction at regular intervals. The ink passage unit 30 further comprises a plurality (specifically, N pieces) of compression chambers C. Each of the compression chambers C is filled with the black ink. Each nozzle is communicated with one corresponding compression chamber C.

The actuator unit 32 is bonded to an upper surface of the ink passage unit 30. The actuator unit 32 comprises a laminate 34 and a plurality (specifically, N pieces) of individual electrodes IE. The laminate 34 is formed by laminating plural layers of piezoelectric sheets and a common electrode sheet. Each of the individual electrodes IE is arranged on an upper surface of the laminate 34. Each of the individual electrodes IE is arranged at a position corresponding to one corresponding compression chamber C. When an actuation signal from an actuating circuit 48 to be described later is supplied to an individual electrode IE configuring the actuator unit 32, a part of the laminate 34 corresponding to this individual electrode (for example, a part inside two broken lines in FIG. 2) deforms, as a result of which a pressure in the compression chamber C facing this portion changes. Due to this, an ink droplet is discharged from the nozzle NZ communicating with this compression chamber C.

The printer PR further comprises a sheet supporting unit 70. The sheet supporting unit 70 is arranged on a lower side of the printing head PH, and is arranged between the upstream roller pair UR and the downstream roller pair DR. The sheet supporting unit 70 comprises a base 72 and a plurality of platens 74. The base 72 has a substantially plate shape. Each of the platens 74 protrudes upward from an upper surface of the base 72. Each of the platens 74 supports the sheet S transported by the upstream roller pair UR toward the downstream side.

An upstream-side nozzle group located on an upstream side (that is, right side in FIG. 2) among the N pieces of nozzles NZ is located on an upstream side than downstream edges (that is, left edges in FIG. 2) of the respective platens 74 in the sub-scanning direction, and a downstream-side nozzle group located on a downstream side (that is, left side in FIG. 2) among the N pieces of nozzles NZ is located on a downstream side than the downstream edges of the respective platens 74 in the sub-scanning direction. Accordingly, the upstream-side nozzle group faces the respective platens 74 when the printing head PH moves in the main-scanning direction, but the downstream-side nozzle group does not face the respective platens 74. With the downstream-side nozzle group not facing the respective platens 74, the ink discharged from the downstream-side nozzle group is not applied to the respective platens 74. Thus, by using the downstream-side nozzle group, the printer PR can perform printing in which no margin is formed at the respective edges of the sheet S on the upstream side and the downstream side in the sub-scanning direction (that is, a so-called no-margin printing) (see a fourth embodiment in FIG. 13 and FIG. 14 to be described later).

The head driving unit DU comprises the actuating circuit 48. The actuating circuit 48 is connected to each of the individual electrodes IE, and supplies the actuation signal to each of the individual electrodes IE. Due to this, the printing head PH is driven, and the ink droplets are discharged from the respective nozzles NZ.

As shown in FIG. 3, the head driving unit DU further comprises a carriage 40, a belt 42, a pair of pulleys 44 (only one of the pulleys 44 is shown in FIG. 3), and a carriage motor 46. The carriage 40 supports the printing head PH. The belt 42 is coupled to the carriage 40. The belt 42 is a loop belt, and is wound on the pair of pulleys 44. The carriage motor 46 is connected to the pulleys 44. When the carriage motor 46 is driven, the pulleys 44 rotate, whereby the belt 42 connected to the pulleys 44 rotates. Due to this, the carriage 40 connected to the belt 42 and the printing head PH supported by the carriage 40 move. The carriage 40 moves reciprocatingly by the carriage motor 46 rotating the pulleys 44 selectively in forward and reverse directions. The reciprocating direction of the carriage 40, that is, a reciprocating direction of the printing head PH is the main-scanning direction, and the main-scanning direction vertically intersects with the sub-scanning direction.

In the present embodiment, the printing head PH discharges the ink toward the sheet S while performing an outgoing movement of one reciprocating movement along the main-scanning direction, but it does not discharge the ink toward the sheet S while performing a returning movement. Hereinbelow, an action by which the printing head PH discharges the ink while performing the outgoing movement will be termed a "main-scanning action". Notably, in modifications, the printing head PH may discharge the ink toward the sheet S while performing the outgoing movement of one reciprocating movement along the main-scanning direction, and also discharge the ink toward the sheet S while performing the returning movement. In this case, one main-scanning action is performed by the printing head PH discharging the ink while performing the outgoing movement, and another main-scanning action is performed by the printing head PH discharging the ink while performing the returning movement.

(Configuration of Terminal Device TR; FIG. 1)

As shown in FIG. 1, the terminal device TR comprises a network interface 102, an operation unit 104, a display unit 106, and a controller 120. The network interface 102 is connected to the LAN 4. The operation unit 104 is configured of a mouse and a keyboard. A user can input various instructions into the terminal device TR by operating the operation unit 104. The display unit 106 is a display for displaying various types of information. The controller 120 comprises a CPU 122 and a memory 124. The CPU 122 performs various processes according to OS program that is not shown, printer driver 126, and the like stored in the memory 124.

The printer driver 126 is a program for creating print data from image data representing a target image being a print target, and supplying the print data to the printer PR. The printer driver 126 may for example be installed to the terminal device TR from a computer-readable storage medium storing the printer driver 126, or may be installed to the terminal device TR from a server on the Internet.

Figure 4:
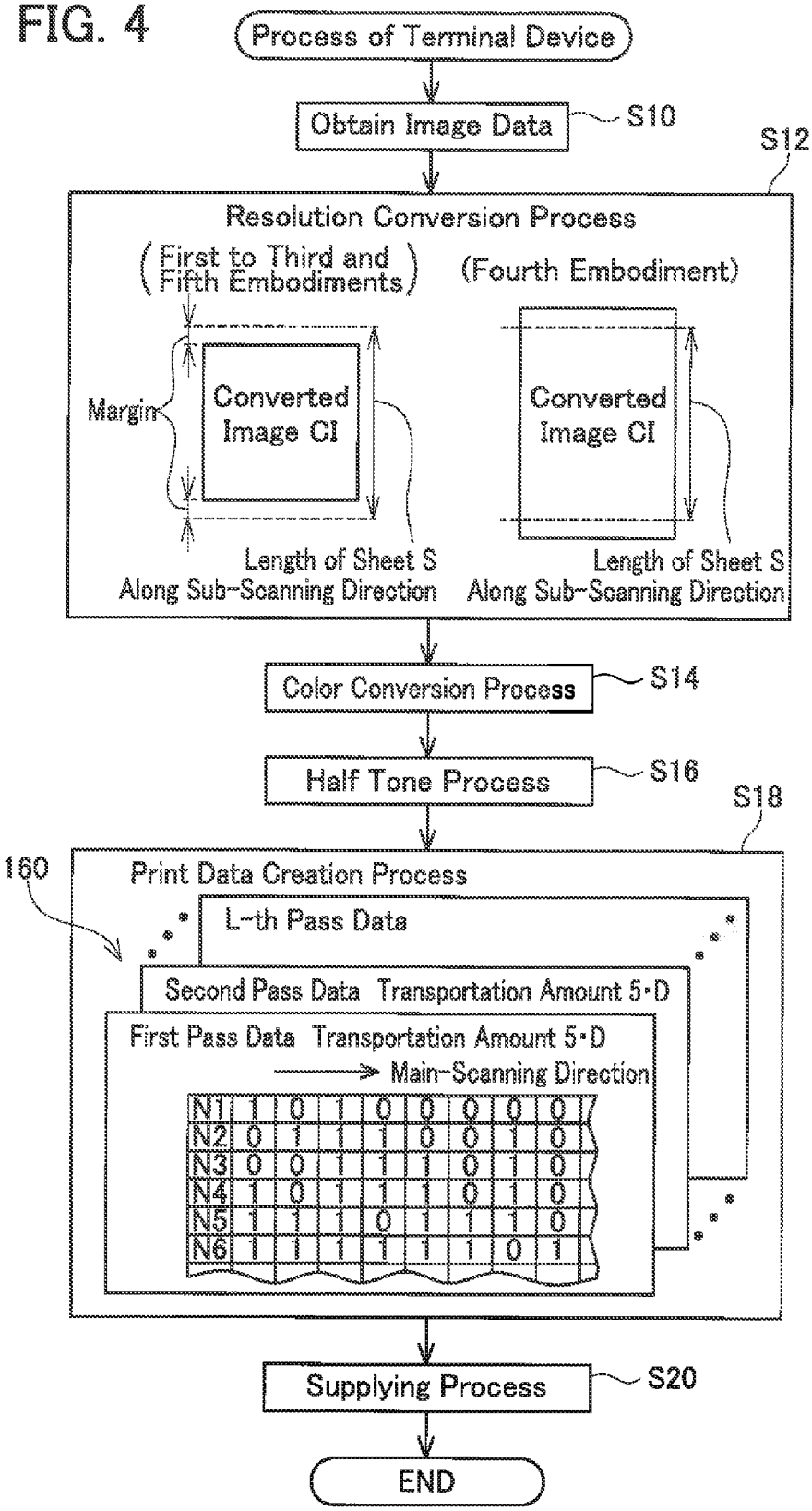
FIG. 4 shows a flowchart of processes performed by a terminal device.

(Processes Performed by Terminal Device TR; FIG. 4)

By referring to FIG. 4, contents of processes that the CPU 122 of the terminal device TR performs according to the printer driver 126 will be described. In S10, the CPU 122 obtains the image data designated by the user. This image data includes a plurality of pixel data, and each of the pixel data indicates an RGB value in multilevel levels (for example, 256 levels). In S10, the CPU 122 further specifies a print resolution and a print image quality (that is, high image quality or normal image quality) based on print conditions designated by the user. The print resolution relates to a number of times the main-scanning action is to be performed upon executing printing. The print image quality relates to a number of nozzles included in a usage nozzle group that is permitted to be used upon executing the printing. Notably, hereinbelow, the print resolution specified in S10 will be referred to as "predetermined resolution".

In S12, the CPU 122 creates converted image data having the predetermined resolution specified in S10 by performing a resolution conversion process on the image data obtained in S10. The converted image data includes a plurality of pixel data (that is, pixel data in a number corresponding to the predetermined resolution), and each pixel data indicates the RGB value in the multilevel level (for example, 256 levels). In the present embodiment, the CPU 122 creates the converted image data representing a converted image CI, which has a smaller size than a length of the sheet S in the sub-scanning direction. That is, the converted image data is data for printing in which a margin is provided in each edge on the upstream side and downstream side of the sheet S in the sub-scanning direction (that is, a so-called margined printing). Further, the converted image CI has a size that is equal to or less than a length of the sheet S in the main-scanning direction.

In S14, the CPU 122 performs a color conversion process on the converted image data created in S12, so as to create CMYK image data. The CMYK image data includes a plurality of pixel data (that is, pixel data in a same number as the converted image data), and each pixel data indicates a CMYK value in the multilevel level (for example, 256 levels).

In S16, the CPU 122 performs a half tone process (for example, processes based on error diffusion method, dithering, and the like) on the CMYK image data created in S14 so as to create binary data. The binary data includes a plurality of pixel data (that is, pixel data in a same number as the CMYK image data), and each pixel data includes a CMYK value in two-levels (that is, "1" or "0"). The pixel data "1" indicates a dot ON (that is, ink is to be discharged), and the pixel data "0" indicates a dot OFF (that is, ink is not to be discharged). In the present embodiment, dots are formed on the sheet S by the nozzles NZ formed in the printing head PH (see FIG. 2 and the like) discharging the ink droplets of black (K) ink. Due to this, the respective pixel data in the binary data are configured by "K=1" or "K=0". However, for example, in a case where nozzle groups corresponding to CMY are provided other than the aforementioned nozzles NZ, the respective pixels in the binary data would include not only the value corresponding to K, but also values corresponding to CMY. Further, although data in two levels indicating "1" or "0" is created in the present embodiment, data in three or more levels may be created. For example, four-level data using a large dot ON, a middle dot ON, a small dot ON, and a dot OFF may be created.

In S18, the CPU 122 creates print data using the binary data created in S16. Especially, in a case where the print image quality specified in S10 is the high image quality, the CPU 122 creates print data 160 for performing printing in which a pass that uses all of the N pieces of nozzles NZ formed in the printing head PH is not included, that is, printing in which only a partial nozzle group among the N pieces of nozzles NZ are used in all of the passes (hereinbelow referred to as "high image quality printing"). Here, a "pass" means one main-scanning action by the printing head PH. On the other hand, in a case where the print image quality specified in S10 is the normal image quality, the CPU 122 creates print data (not shown) for performing printing including a pass that uses all of the N pieces of nozzles NZ (hereinbelow referred to as "normal image quality printing"). The normal image quality printing is a conventionally known printing, so description thereof will be omitted.

The print data 160 for performing the high image quality printing includes a plurality of pass data. One pass data corresponds to one pass (that is, one main-scanning action). In each pass data, nozzles and pixel data within the binary data are associated for each of the N pieces of nozzles NZ (for example, nozzles N1 to N6, and the like). For example, in the pass data for the $1^{st}$ pass shown in S18 of FIG. 4, the respective pixel data associated with the nozzle N1 indicate "1", "0", "1", etc., sequentially from the left side. This means that, in the course of one pass, the nozzle N1 is to discharge the ink droplet, not discharge the ink droplet, then discharge the ink droplet, sequentially in this order. As described above, in the high image quality printing, only a partial nozzle group among the N pieces of nozzles NZ is used in each pass. That is, in each pass, at least one nozzle does not discharge the ink. Accordingly, only the pixel data "0" is associated to the at least one nozzle in each pass data in the print data 160.

Each pass data further includes transportation amount data indicating a transportation amount of the sheet S in the sub-scanning direction. For example, the pass data for the $1^{st}$ pass includes the transportation amount data indicating a distance of 5×D (i.e. 5·D). This means that the sheet S is to be transported along the sub-scanning direction by 5·D before the main-scanning action for the $1^{st}$ pass is to be performed. Here, D denotes a length between two adjacent dots that are to be formed on the sheet S along the sub-scanning direction (that is, 1-dot pitch). As for a more detailed creating method of the print data 160, such will be described again after the explanation on the printing to be performed by the print data 160.

In S20, the CPU 122 supplies the print data 160 created in S18 to the printer PR. Due to this, the control circuit 20 of the printer PR controls the sheet transportation unit TU and the head driving unit DU according to the print data 160, and prints the target image represented by the print data 160, that is, the target image represented by the image data obtained in S10 onto the sheet S.

Figure 5:
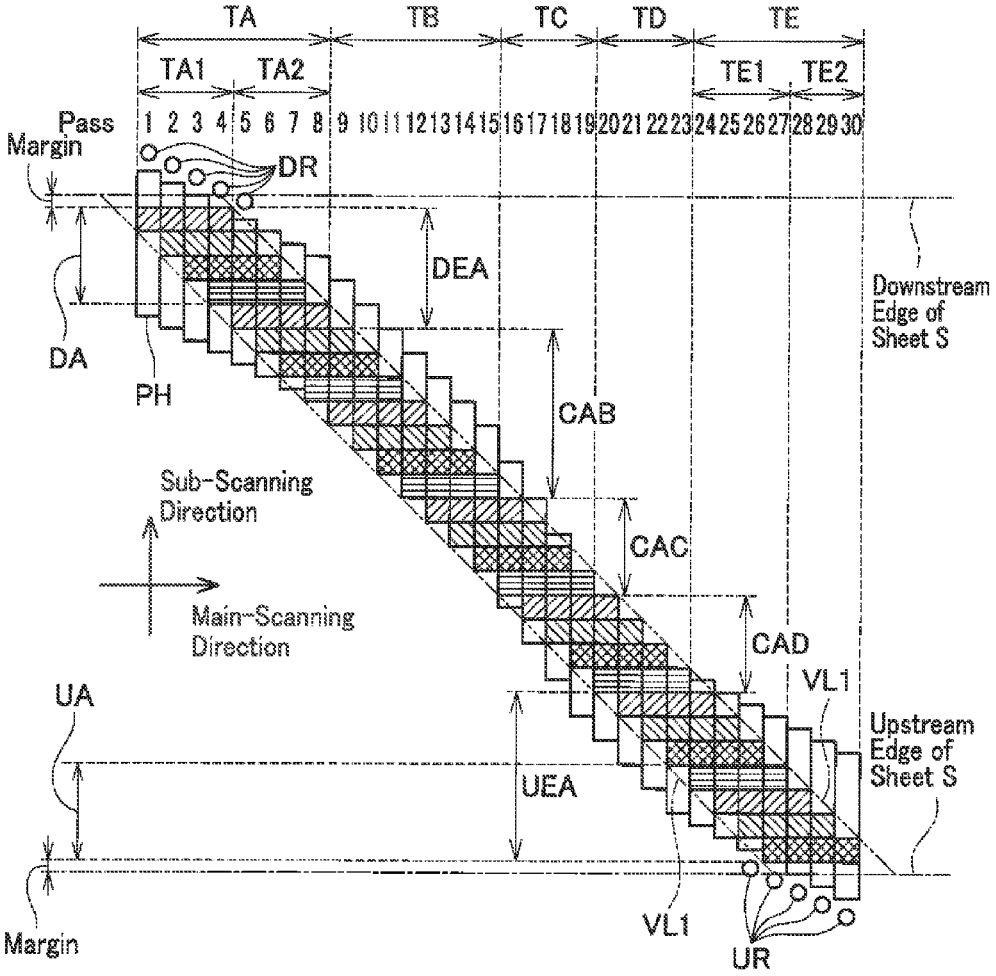
FIG. 5 shows a position of a printing head relative to a sheet in each pass.

(Contents of Printing; FIG. 5)

Next, by referring to FIG. 5, contents of the printing that the printer PR performs according to the print data 160 will be described. The present embodiment assumes that the printer PR is to print a so-called solid image on the sheet S. FIG. 5 shows how the printing head PH moves relatively along the sub-scanning direction relative to the sheet S. In $1^{st}$ to $5^{th}$ passes, a position of the downstream roller pair DR is shown. Further, a downstream edge of the sheet S is located on an upstream side (that is, lower side) than the downstream roller pair DR in the $1^{st}$ to $4^{th}$ passes, and is located on a downstream side (that is, upper side) than the downstream roller pair DR in the $5^{th}$ pass. That is, the sheet S is not supported by the downstream roller pair DR during in the $1^{st}$ to $4^{th}$ passes, and is supported by the downstream roller pair DR in the $5^{th}$ pass. Further, in $26^{th}$ to $30^{th}$ passes, a position of the upstream roller pair UR is shown. Further, in the $26^{th}$ pass, an upstream edge of the sheet S is located on the upstream side (that is, the lower side) than the upstream roller pair UR, and is located on the downstream side (that is, the upper side) than the upstream roller pair UR in the $27^{th}$ to $30^{th}$ passes. That is, the sheet S is supported by the upstream roller pair UR in the $26^{th}$ pass, but is not supported by the upstream roller pair UR during in the $27^{th}$ to $30^{th}$ passes. Accordingly, the sheet S is supported only by the upstream roller pair UR in the $1^{st}$ to $4^{th}$ passes, is supported by both the upstream roller pair UR and the downstream roller pair DR in the $5^{th}$ to $26^{th}$ passes, and is supported only by the downstream roller pair DR in the $27^{th}$ to $30^{th}$ passes.

Further, hatching within the printing head PH show the positions of the usage nozzle group that is permitted to be used among the N pieces of nozzles NZ formed in the printing head PH. That is, in each pass, the ink is discharged from the usage nozzle group located at the position indicated by the hatching, however, ink is not discharged from unused nozzle groups located at the positions that are not indicated by the hatching. As can be understood from the hatchings in each pass, all of the nozzles formed in the printing head PH are not used at once in any of the $1^{st}$ to $30^{th}$ passes, and only a partial nozzle group is used. Due to this, the high image quality printing can be performed. The reason herefor will be described next.

For example, in a configuration in which all of the nozzles formed in the printing head PH are used at once, the number of nozzles in the usage nozzle group (hereinbelow referred to as "number of usage nozzles") is large, so it is highly likely that lengths of gaps between the respective nozzles and the sheet (hereinbelow referred to simply as "gaps") do not become constant. If the lengths of the respective gaps for the nozzles do not become constant, application positions of the respective ink droplets discharged from the respective nozzles onto the sheet S are not stabilized, whereby the print image quality is deteriorated. On the other hand, for example, in the configuration in which only some of the nozzles among the N pieces of nozzles NZ are used, due to the number of usage nozzles being small, the likelihood that the lengths of gaps of the respective nozzles becoming constant is high. Due to this, since the application positions of the respective ink droplets discharged from the respective nozzles onto the sheet S are stabilized, the high image quality printing can be performed as a result.

Further, for example, there is a possibility that a gap length for the upstream nozzles located on the upstream side among the usage nozzle group and a gap length for the downstream nozzles located on the downstream side among the usage nozzle group. In a configuration in which all of the nozzles NZ formed in the printing head PH are used, the difference between the gap length for the upstream nozzles and the gap length for the downstream nozzles may become large. In such a case, even if the ink droplets are discharged at a same timing from both the upstream nozzles and the downstream nozzles, positions of the respective dots formed on the sheet S by those ink droplets are displaced in the main-scanning direction, so the print image quality is thereby deteriorated. On the other hand, for example, in a configuration in which only some of the nozzles among the N pieces of nozzles NZ are used, the difference between the gap length for the upstream nozzles and the gap length for the downstream nozzles can be made smaller. Due to this, the positions of the respective dots can be prevented from being displaced in the main-scanning direction, and as a result, high image quality printing can be performed.

Further, for example, in the configuration in which all of the nozzles NZ formed in the printing head PH are used, the transportation amount used for transporting the sheet S that is to take place before each main-scanning action becomes large. When the transportation amount of the sheet S is large, there is a possibility that transportation accuracy for the sheet S is deteriorated, whereby the dots may be formed by being displaced in the sub-scanning direction from their originally aimed positions. On the other hand, in the configuration in which only some of the nozzles among the N pieces of nozzles NZ are used, the transportation amount of the sheet S becomes smaller, and the transportation accuracy for the sheet S can be increased. Due to this, the dots can be prevented from being formed at positions displaced in the sub-scanning direction from their originally aimed positions, and as a result, high image quality printing can be performed.

$1^{st}$ to $30^{th}$ passes for printing shown in FIG. 5 are divided into five sections (that is, intervals) TA to TE according to the transportation amount of the sheet S in the sub-scanning direction. The transportation amount in the section TB of $9^{th}$ to $15^{th}$ passes and the transportation amount in the section TD of $20^{th}$ to $23^{rd}$ passes are identical, and hereinbelow this transportation amount will be referred to as a "standard transportation amount". The section TA of $1^{st}$ to $8^{th}$ passes is a section having a transportation amount smaller than the standard transportation amount. The transportation amount of the section TA will hereinbelow be referred to as a "small transportation amount". The section TC of $16^{th}$ to $19^{th}$ passes is a section having a transportation amount larger than the standard transportation amount. The transportation amount of the section TC will hereinbelow be referred to as a "large transportation amount". The section TE of $24^{th}$ to $30^{th}$ passes is a section having the small transportation amount.

In the sections TB, TD where the transportation is performed with the standard transportation amount, a same number of usage nozzles is used in each pass. The number of usage nozzles in the section that performs the transportation by the standard transportation amount will hereinbelow be denoted as "n". The section TA in which the transportation is performed by the small transportation amount is further divided into a section TA1 and a section TA2. The section TA1 is a section in which a number of usage nozzles to be used in a current pass is different from a number of usage nozzles that was used in a previous pass. The section TA2 is a section in which the number of usage nozzles to be used in the current pass is identical to the number of usage nozzles that was used in the previous pass (that is, section TA2 in which the number of usage nozzles is maintained to "n"). Further, the section TE in which the transportation is performed by the small transportation amount is further divided into a section TE1 and a section TE2. The section TE1 is a section in which the number of usage nozzles to be used in the current pass is identical to the number of usage nozzles that was used in the previous pass (that is, section TE1 in which the number of usage nozzles is maintained to "n"). The section TE2 is a section in which the number of usage nozzles to be used in the current pass is different from the number of usage nozzles that was used in the previous pass.

Further, in the present embodiment, a print resolution in the sub-scanning direction is for forming four lines of rasters configuring the target image in a one-nozzle pitch length on the sheet S. The one-nozzle pitch is a distance between two nozzles that are adjacent in the sub-scanning direction. Further, a raster is a group of dots aligned linearly along the main-scanning direction on the sheet S. In the present embodiment, in order to form four lines of rasters in the one-nozzle pitch length, four passes (that is, four times of main-scanning actions) are performed therein, which will be called "four-pass interlace printing". Notably, in a modification, the print resolution in the sub-scanning direction may be for performing the interlace printing at pass numbers other than four passes. Further, hereinbelow, a downstream and an upstream in the sub-scanning direction will be referred simply as "downstream" and "upstream" by omitting the mention of the "sub-scanning direction".

(Section TA1 of $1^{st}$ to $4^{th}$ Passes)

As a preparatory process for performing the printing of the $1^{st}$ pass, the control circuit 20 of the printer PR firstly supplies a driving signal at least to the upstream motor UM (see FIG. 2) of the sheet transportation unit TU so that the sheet S is transported to a predetermined print start position. Then, the control circuit 20 controls the sheet transportation unit TU by using pass data for the $1^{st}$ pass. Transportation amount data included in the pass data for the $1^{st}$ pass indicates the small transportation amount (for example, 5·D in S18 of FIG. 4). Accordingly, the control circuit 20 performs the transportation of the sheet S by the small transportation amount by supplying the driving signal to the respective motors UM, etc. in the sheet transportation unit TU. Due to this, the sheet S is moved to a position where the main-scanning action for the $1^{st}$ pass is to be performed.

Then, the control circuit 20 uses the pass data for the $1^{st}$ pass to control the head driving unit DU. Specifically, the control circuit 20 firstly supplies a driving signal to the carriage motor 46 (see FIG. 3) of the head driving unit DU, and causes the printing head PH to perform the reciprocating movement along the main-scanning direction. The control circuit 20 further supplies an actuation signal to the actuating circuit 48 (see FIG. 2) of the head driving unit DU during the outgoing movement of the reciprocating movement so as to cause the ink droplet to be discharged at a position corresponding to pixel data "1" included in the pass data for the $1^{st}$ pass from the nozzle corresponding to the aforementioned pixel data. In the $1^{st}$ pass, a gap is present between the downstream edge of the sheet S and the usage nozzle group. This gap corresponds to a length of the margin to be provided at the downstream edge of the sheet S. Due to this, the margined printing is performed at the downstream edge of the sheet S.

Next, the control circuit 20 controls the sheet transportation unit TU and the head driving unit DU by sequentially using each of pass data for $2^{nd}$ to $4^{th}$ passes. Respective transportation amount data included in the pass data for $2^{nd}$ to $4^{th}$ passes indicate the small transportation amount. Accordingly, the transportation of the sheet S by the small transportation amount is carried out prior to each of the main-scanning actions for the $2^{nd}$ to $4^{th}$ passes is to be performed. In the $2^{nd}$ to $4^{th}$ passes, the sheet S is supported only by the upstream roller pair UR. Further, in the $2^{nd}$ to $4^{th}$ passes, since an area of the usage nozzle group in the printing head PH sequentially increases, the number of usage nozzles increases sequentially. As a result, the usage nozzle group of the $4^{th}$ pass includes a downmost-stream nozzle that is located at the downmost-stream side among the N pieces of nozzles NZ formed in the printing head PH. The number of usage nozzles of the $4^{th}$ pass is "n".

Next, the control circuit 20 controls the sheet transportation unit TU and the head driving unit DU by sequentially using each of pass data for $5^{th}$ to $30^{th}$ passes. Due to this, the transportation of the sheet S by the transportation amount indicated by the transportation amount data included in the pass data and the main-scanning action corresponding to the pixel data included in the pass data are performed for each of the pass data for the $5^{th}$ to $30^{th}$ passes. Hereinbelow, printing for $5^{th}$ and subsequent passes will be described.

(Section TA2 for $5^{th}$ to $8^{th}$ Passes)

The respective transportation amounts for the $5^{th}$ to $8^{th}$ passes are the small transportation amount. Further, the respective numbers of usage nozzles for the $5^{th}$ to $8^{th}$ passes are "n". The respective usage nozzle groups of the $5^{th}$ to $8^{th}$ passes shift toward the upstream side (that is, lower side in FIG. 5) than the usage nozzle group in the previous pass, while being in a state of maintaining "n" as their numbers of usage nozzles. Hereinbelow, the shifting of the usage nozzle group in the upstream side while being in the state of maintaining "n" as its number of usage nozzles will be referred to as "upstream side shifting". The upstream side shifting means that a position of the usage nozzle group in the printing head PH shifts to the upstream side. In the section TA2, the upstream side shifting is performed 4 times for the $5^{th}$ to $8^{th}$ passes. Due to the upstream side shifting having taken place for 4 times, the usage nozzle group of the $8^{th}$ pass includes an uppermost-stream nozzle located on the uppermost-stream side among the N pieces of nozzles NZ formed in the printing head PH.

In each pass in the section TA1 and the section TA2, a downstream edge image, which is a part of the target image, is formed in a downstream edge area DEA that is located on the downstream edge of the sheet S in the sub-scanning direction. Especially, the printing of the section TA2 for the $5^{th}$ to $8^{th}$ passes is printing which satisfies: performing the transportation of the sheet S by the small transportation amount for 4 times, maintaining the number of usage nozzles to "n" in the 4 times of main-scanning actions which are performed after the 4 times of transportations, and performing the upstream side shifting.

(Section TB for $9^{th}$ to $15^{th}$ Passes)

The respective transportation amounts for the $9^{th}$ to $15^{th}$ passes are the standard transportation amount. Further, the respective numbers of usage nozzles for the $9^{th}$ to $15^{th}$ passes are "n". Each of the usage nozzle groups of the $9^{th}$ to $15^{th}$ passes includes the uppermost-stream nozzle, and matches the usage nozzle group of the previous pass (that is, the usage nozzle groups do not shift). A central image, which is a part of the target image, is formed in a central area CAB located at a center of the sheet S in the sub-scanning direction by each pass in the section TB. The printing of the section TB is printing which satisfies: performing the transportation of the sheet S by the standard transportation amount 7 times, maintaining "n" as the number of usage nozzles in the 7 times of main-scanning actions which are performed after the 7 times of transportations, and not shifting the usage nozzle group.

(Section TC of $16^{th}$ to $19^{th}$ Passes)

The respective transportation amounts for the $16^{th}$ to $19^{th}$ passes are the large transportation amount. Further, the respective numbers of usage nozzles for the $16^{th}$ to $19^{th}$ passes are "n". The respective usage nozzle groups of the $16^{th}$ to $19^{th}$ passes shift toward the downstream side (that is, upper side in FIG. 5) than the usage nozzle group in the previous pass, while being in the state of maintaining "n" as their numbers of usage nozzles. Hereinbelow, the shifting of the usage nozzle group in the downstream side while being in the state of maintaining "n" as its number of usage nozzles will be referred to as "downstream side shifting". The downstream side shifting means that the position of the usage nozzle group in the printing head PH shifts to the downstream side. In the section TC, the downstream side shifting is performed 4 times for the $16^{th}$ to $19^{th}$ passes. Due to the downstream side shifting having taken place for 4 times, the usage nozzle group of the $19^{th}$ pass includes the downmost-stream nozzle. A central image, which is another part of the target image, is formed in a central area CAC located at the center of the sheet S in the sub-scanning direction by each pass in the section TC. The central area CAC is an area that is located on the upstream side than the central area CAB. The printing of the section TC is printing which satisfies: performing the transportation of the sheet S by the large transportation amount 4 times, maintaining "n" as the number of usage nozzles in the 4 times of main-scanning actions which are performed after the 4 times of transportations, and performing the downstream side shifting. In the section TC, transportation accuracy of the sheet S is high, due to the sheet S being supported by both the upstream roller pair UR and the downstream roller pair DR. Due to this, even if the sheet S is transported by the large transportation amount in the section TC, the sheet S can still be transported properly, and as a result, decrease in the print image quality of the central area CAC can be prevented.

(Section TD of $20^{th}$ to $23^{rd}$ Passes)

The respective transportation amounts for the $20^{th}$ to $23^{rd}$ passes are the standard transportation amount. Further, the respective numbers of usage nozzles for the $20^{th}$ to $23^{rd}$ passes are "n". Each of the usage nozzle groups of the $20^{th}$ to $23^{rd}$ passes includes the downmost-stream nozzle, and matches the usage nozzle group of the previous pass (that is, the usage nozzle groups do not shift). A central image, which is a part of the target image, is formed in a central area CAD located at the center of the sheet S in the sub-scanning direction by each pass in the section TD. The central area CAD is an area located on the upstream side of the central area CAC. The printing of the section TD is printing which satisfies: performing the transportation of the sheet S by the standard transportation amount 4 times, maintaining "n" as the number of usage nozzles in the 4 times of main-scanning actions which are performed after the 4 times of transportations, and not shifting the usage nozzle group.

(Section TE1 of $24^{th}$ to $27^{th}$ Passes)

The respective transportation amounts for the $24^{th}$ to $27^{th}$ passes are the small transportation amount. Further, the respective numbers of usage nozzles for the $24^{th}$ to $27^{th}$ passes are "n". In the $24^{th}$ to $27^{th}$ passes, the upstream side shifting is performed 4 times. Due to the upstream side shifting having taken place for 4 times, the usage nozzle group of the $27^{th}$ pass includes the uppermost-stream nozzle.

(Section TE2 of $28^{th}$ to $30^{th}$ Passes)

The respective transportation amounts for the $28^{th}$ to $30^{th}$ passes are the small transportation amount. Further, each of the numbers of usage nozzles for the $28^{th}$ to $30^{th}$ passes is smaller than the number of usage nozzles of its previous pass. In the $30^{th}$ pass, a gap is present between the upstream edge of the sheet S and the usage nozzle group. This gap corresponds to a length of the margin to be provided at the upstream edge of the sheet S. Due to this, the margined printing is performed at the upstream edge of the sheet S.

In each pass in the section TE1 and the section TE2, an upstream edge image, which is a part of the target image, is formed in an upstream edge area UEA that is located on the upstream edge of the sheet S in the sub-scanning direction. Especially, the printing of the section TE2 for the $24^{th}$ to $27^{th}$ passes is printing which satisfies: performing the transportation of the sheet S by the small transportation amount for 4 times, maintaining the number of usage nozzles to "n" in the 4 times of main-scanning actions which are performed after the 4 times of transportations, and performing the upstream side shifting.

The printing of the target image onto the sheet S is completed when the printing of all of the $1^{st}$ to $30^{th}$ passes have been performed. When the printing of the target image is completed, the control circuit 20 controls the sheet transportation unit TU to transport the sheet S to the sheet feed-out tray. Due to this, the sheet S on which the target image has been formed can be provided to a user.

(Reason Why Transportation Amounts Differ Among Sections TA to TE)

As described above, in the printing of FIG. 5, the transportation amounts of the respective sections TA to TE differ. The standard transportation amount employed in the section TB or the section TD is a transportation amount for realizing the printing in the predetermined resolution as specified in S10 of FIG. 4 by a plurality of times of main-scanning actions, in a state where the sheet S is transported by a constant transportation amount, the number of usage nozzles is maintained to "n", and the usage nozzle group does not shift. More specifically, the standard transportation amount is n·D that is determined by the number of usage nozzles "n".

The reason why the small transportation amount is employed in the section TA is as follows. As described above, the sheet S is not supported by the downstream roller pair DR in the $1^{st}$ to $4^{th}$ passes, and is supported only by the upstream roller pair UR. In this state, the transportation accuracy of the sheet S is low compared to the state where the sheet S is supported by both rollers UR, UD. If the transportation amount is large in the state with the low transportation accuracy, it becomes difficult to transport the sheet S to the suitable position, as a result of which the print image quality is deteriorated. In view of such a circumstance, the small transportation amount that is smaller than the standard transportation amount is employed in the $1^{st}$ to $4^{th}$ passes in which the sheet S is supported only by the upstream roller pair UR. Due to this, the sheet S can be transported to the suitable position, and the high image quality printing can be performed. An area DA in FIG. 5 indicates an area on the sheet S that is printed in the $1^{st}$ to $4^{th}$ passes. Further, since the printing of the area DA is performed in the $1^{st}$ to $4^{th}$ passes by the small transportation amount, high image quality printing can be performed in the $5^{th}$ to $7^{th}$ passes for performing the printing of the area DA by employing the same small transportation amount. Due to this, the small transportation amount is employed also in the $5^{th}$ to $7^{th}$ passes. Notably, the $8^{th}$ pass is irrelevant to the printing of the area DA, the small transportation amount is employed as the transportation amount for the $8^{th}$ pass in the present embodiment. However, in a modification, the standard transportation amount employed in the section TB may be employed as the transportation amount for the $8^{th}$ pass.

The reason why the small transportation amount is employed in the section TE is the same reason as to why the small transportation amount is employed in the section TA. That is, the sheet S is not supported by the upstream roller pair UR in the $27^{th}$ to $30^{th}$ passes, and is supported only by the downstream roller pair DR. Accordingly, in the $27^{th}$ to $30^{th}$ passes in which the sheet S is supported only by the downstream roller pair DR, the small transportation amount is employed so as to transport the sheet S to the suitable position. An area UA in FIG. 5 indicates an area on the sheet S that is printed in the $27^{th}$ to $30^{th}$ passes. Further, since the printing of the area UA is performed in the $27^{th}$ to $30^{th}$ passes by the small transportation amount, high image quality printing can be performed in the $24^{th}$ to $26^{th}$ passes for performing the printing of the area UA by employing the same small transportation amount. Due to this, the small transportation amount is employed also in the $24^{th}$ to $26^{th}$ passes.

The number of usage nozzles "n" in each of the sections TA2, TE1 for printing the respective edge areas DEA, UEA of the sheet S is equal to the number of usage nozzles "n" in each of the sections TB, TC, TD for printing the respective central areas CAB, CAC, CAD on the sheet S. Although explanation will be given in detail later, by making the number of usage nozzles for printing the edge areas of the sheet S to be of the same number as the number of usage nozzles for printing the central areas of the sheet S, fast-speed printing can be performed. Accordingly, "n" is employed as the number of usage nozzles of each of the sections TA2, TE1 for the fast-speed printing in the present embodiment. Further, in the section TA2, the upstream side shifting is performed, since the sheet S is transported by the small transportation amount that is smaller than the standard transportation amount in the state where "n" is maintained as the numbers of usage nozzles. As a result, in the last pass of the section TA2, namely the $8^{th}$ pass, the usage nozzle group comes to include the uppermost-stream nozzle, and a state in which no further upstream side shifting can be performed is assumed. Further, in each of the sections TB, TD, the usage nozzle groups do not shift due to the sheet S being transported by the standard transportation amount. Accordingly, in order to perform the upstream side shifting in the section TE2, a state in which further upstream side shifting can be performed needs to be assumed before the printing of the section TE is started. The large transportation amount that is larger than the standard transportation amount is employed in the section TC for this purpose. The downstream side shifting is performed in the $16^{th}$ to $19^{th}$ passes of the section TC, since the sheet S is transported by the large transportation amount that is larger than the standard transportation amount in the state where "n" is maintained as the numbers of usage nozzles. As a result, the upstream side shifting can be performed in the section TE2. In other words, in the section TE2, the sheet S can be transported by the small transportation amount that is smaller than the standard transportation amount in the state where "n" is maintained as the numbers of usage nozzles. That is, the section TC can be said as being a preparatory section for performing the upstream side shifting in the section TE2 for the purpose of fast-speed printing.

Figure 6:
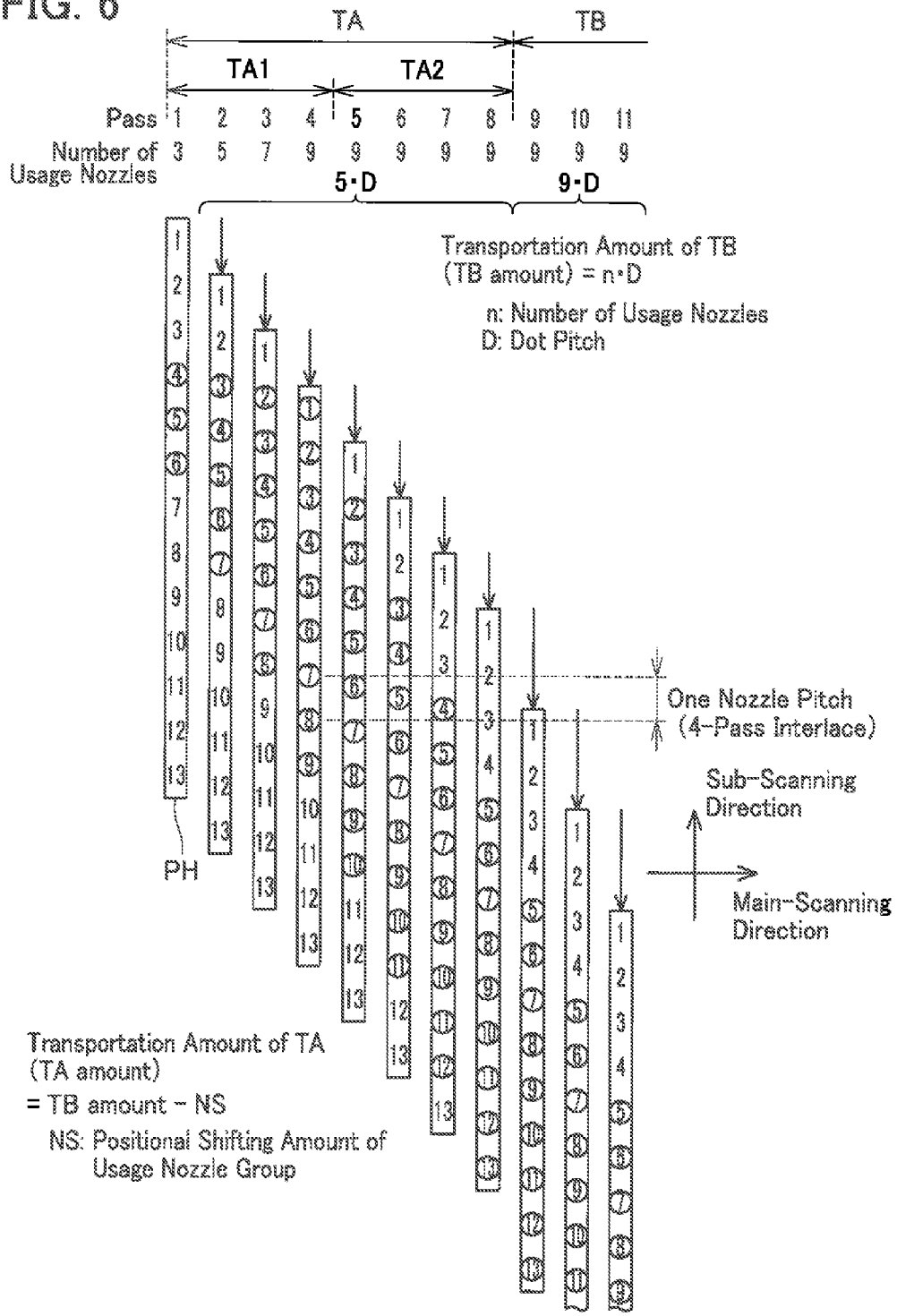
FIG. 6 shows how printing is performed for $1^{st}$ pass to $11^{th}$ pass.
Figure 7:
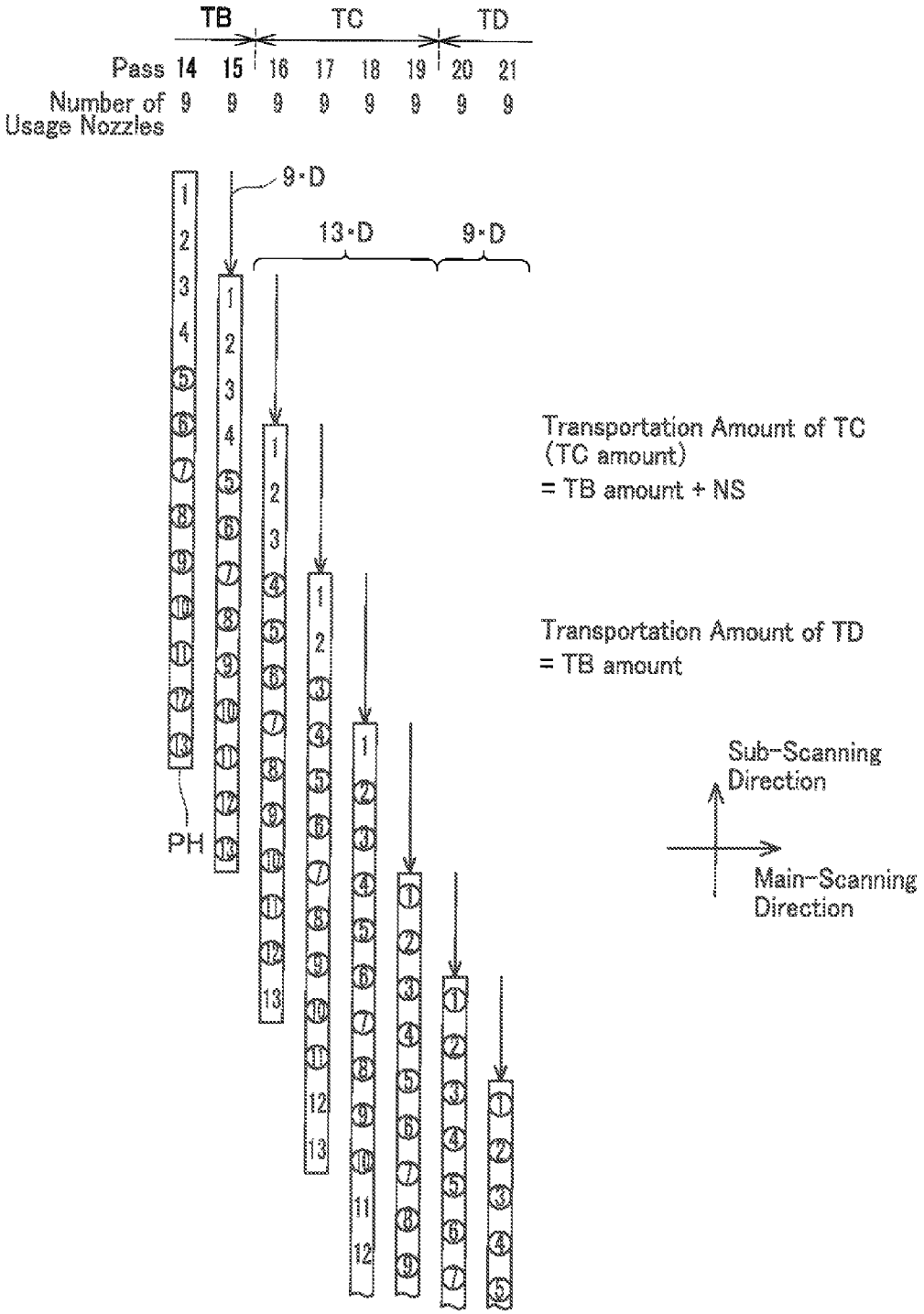
FIG. 7 shows how printing is performed for $14^{th}$ pass to $21^{st}$ pass.
Figure 8:
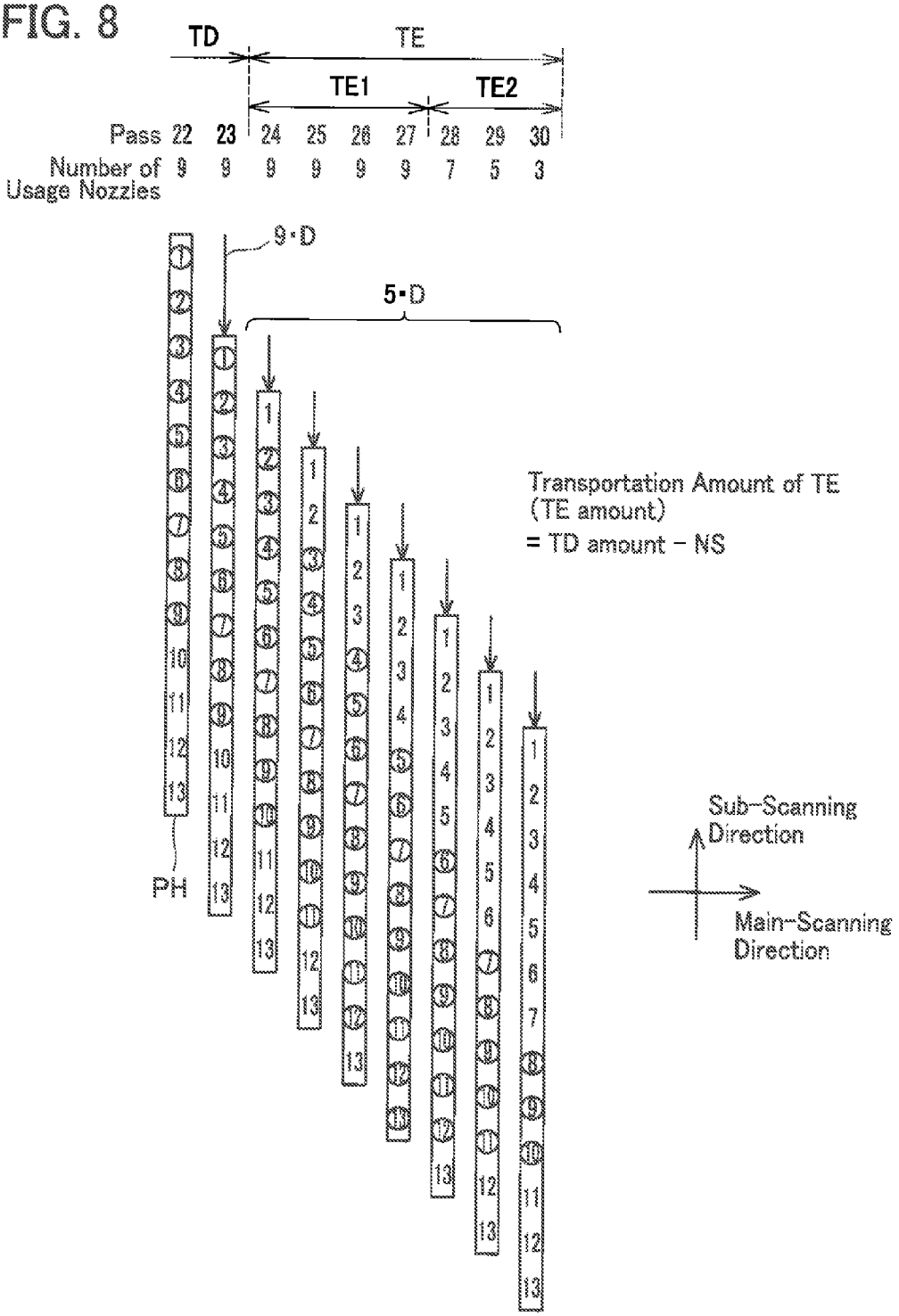
FIG. 8 shows how printing is performed for $12^{th}$ pass to $30^{th}$ pass.

(Details of Printing; FIG. 6 to FIG. 8)

Next, by referring to FIG. 6 to FIG. 8, the details of the printing of FIG. 5 will be explained. FIG. 6 to FIG. 8 show how the printing head PH moves relatively along the sub-scanning direction with respect to the sheet S. In FIG. 2 and FIG. 3, for example, 400 or more nozzles NZ are formed in the printing head PH, but FIG. 6 to FIG. 8 shows a configuration in which 13 nozzles are formed in the printing head PH for the sake of convenience of explanation. Numbers "1" to "13" in the printing head PH indicate the positions of the respective nozzles. That is, the number "1" and the number "13" in the printing head PH respectively show the positions of the downmost-stream nozzle and the uppermost-stream nozzle. Hereinbelow, a nozzle existing at a position indicated by a number "p (p being each integer of 1 to 13)" will be denoted as "nozzle [p]", for the sake of convenience. Further, among the numbers described in the printing head PH, encircled numbers show the position of the usage nozzle group, and numbers that are not encircled show the positions of the unused nozzle groups.

(Printing of $1^{st}$ to $11^{th}$ Passes; FIG. 6)

FIG. 6 shows the $1^{st}$ to $11^{th}$ passes. A gap indicating one-nozzle pitch is shown between the nozzle [7] and the nozzle [8] of the $4^{th}$ pass. Further, in this gap, the ink is discharged from the nozzle of the $4^{th}$ pass, the nozzle [6] of the $5^{th}$ pass, the nozzle [5] of the $6^{th}$ pass, and the nozzle [4] of the $7^{th}$ pass. That is, four lines of rasters are formed by 4 times of main-scanning actions of the $4^{th}$ to $7^{th}$ passes within one-nozzle pitch in the sub-scanning direction on the sheet S, whereby the 4-pass interlace printing is performed. Notably, 4 lines of rasters being formed in one-nozzle pitch means that the one-nozzle pitch is equal to 4×D (i.e. 4·D).

The numbers of usage nozzles increase sequentially from "3", "5", "7", and then "9" in the section TA1 for the $1^{st}$ to $4^{th}$ passes. In the section TA2 for the $5^{th}$ to $8^{th}$ passes, the upstream side shifting of the usage nozzle group is performed in the state where the numbers of usage nozzles is maintained to "9". For example, compared to the usage nozzle group for the $4^{th}$ pass including the nozzle [1] to the nozzle [9], the usage nozzle group for the $5^{th}$ pass includes the nozzle [2] to the nozzle [10]. That is, in the $5^{th}$ pass, the upstream side shifting amounting to one nozzle is performed. Similarly, in each of the $6^{th}$ to $8^{th}$ passes, the upstream side shifting amounting to one nozzle is performed. As a result, the usage nozzle group for the $8^{th}$ pass includes the uppermost-stream nozzle [13]. In other words, in the $5^{th}$ to $8^{th}$ passes, the shifting amount of the positions of the usage nozzle group (hereinbelow referred to by using a reference sign "NS") is of one-nozzle pitch, that is, a distance of 4·D. Further, in the section TB for the $9^{th}$ to $11^{th}$ passes, the number of usage nozzles "9" is maintained, and the usage nozzle groups do not shift (that is, usage nozzle group includes the nozzle [5] to the nozzle [13]).

The transportation amount $TB_{amount}$ (that is, standard transportation amount) of the section TB is the transportation amount for performing the printing in the predetermined resolution by a plurality of times of main-scanning actions, in the state where the sheet S is transported by the constant (i.e. regular) transportation amount, the number of usage nozzles is maintained to "9", and the usage nozzle group does not shift. As described above, in the case where the number of usage nozzles is "n", the $TB_{amount}$ is n·D (i.e. n×D). In the example of FIG. 6, since the number of usage nozzles is "9", the $TB_{amount}$ is 9·D.

The transportation amount $TA_{amount}$ (i.e. small transportation amount) of the section TA is a value in which a shifting amount NS of the position of the usage nozzle group in the section TA2 is subtracted from the $TB_{amount}$. In the example of FIG. 6, the $TB_{amount}$ and NS are respectively 9·D and 4·D, whereby the $TB_{amount}$ is 5·D.

(Printing of $14^{th}$ to $21^{st}$ Passes; FIG. 7)

FIG. 7 shows the $14^{th}$ to $21^{st}$ passes. Notably, in FIG. 7, the $12^{th}$ and $13^{th}$ passes that are the continuation of FIG. 6 are omitted. In the section TB of the $14^{th}$ to $15^{th}$ passes, the number of usage nozzles "9" is maintained, and the usage nozzle group does not shift (i.e. the usage nozzle group includes the nozzle [5] to the nozzle [13]). In the section TC of the $16^{th}$ to $19^{th}$ passes, the downstream side shifting of the usage nozzle group is performed in the state where "9" is maintained as the number of usage nozzles. For example, as compared to the usage nozzle group of the $15^{th}$ pass being the nozzle [5] to the nozzle [13], the usage nozzle group of the $16^{th}$ pass is the nozzle [4] to the nozzle [12]. That is, in the $16^{th}$ pass, the downstream side shifting amounting to one nozzle is performed. Similarly, in each of the $17^{th}$ to $19^{th}$ passes, the downstream side shifting amounting to one nozzle is performed. As a result, the usage nozzle group for the $19^{th}$ pass includes the downmost-stream nozzle [1]. In other words, in the $16^{th}$ to $19^{th}$ passes, the shifting amount NS of the positions of the usage nozzle group is of the one-nozzle pitch (i.e. a distance of 4·D). Further, in the section TD for the $20^{th}$ and $21^{st}$ passes, the number of usage nozzles "9" is maintained, and the usage nozzle groups do not shift (i.e. usage nozzle group includes the nozzle [1] to the nozzle [9]).

The transportation amount $TC_{amount}$ (i.e. small transportation amount) of the section TC is a value in which the shifting amount NS of the position of the usage nozzle group in the section TC is added to the $TB_{amount}$. In the example of FIG. 7, the $TB_{amount}$ and NS are respectively 9·D and 4·D, whereby the $TC_{amount}$ is 13·D. Further, the transportation amount $TD_{amount}$ (i.e. standard transportation amount) of the section TD is equal to the $TB_{amount}$ (i.e. 9·D).

(Printing of $22^{nd}$ to $30^{th}$ Passes; FIG. 8)

FIG. 8 shows the $22^{nd}$ to $30^{th}$ passes. In the section TD of the $22^{nd}$ and $23^{rd}$ passes, the number of usage nozzles "9" is maintained, and the usage nozzle group does not shift (i.e. the usage nozzle group includes the nozzle [1] to the nozzle [9]). In the section TE1 of the $24^{th}$ to $27^{th}$ passes, the upstream side shifting of the usage nozzle group amounting to one nozzle is performed in the state where "9" is maintained as the number of usage nozzles (i.e. the shifting amount NS of the position of the usage nozzle group is one-nozzle pitch (i.e. distance of 4·D)). As a result, the usage nozzle group of the $27^{th}$ pass includes the uppermost-stream nozzle [13]. Further, in the section TE2 of the $28^{th}$ to $30^{th}$ passes, the number of usage nozzles decreases sequentially from "7", "5", and then to "3".

Figure 9:
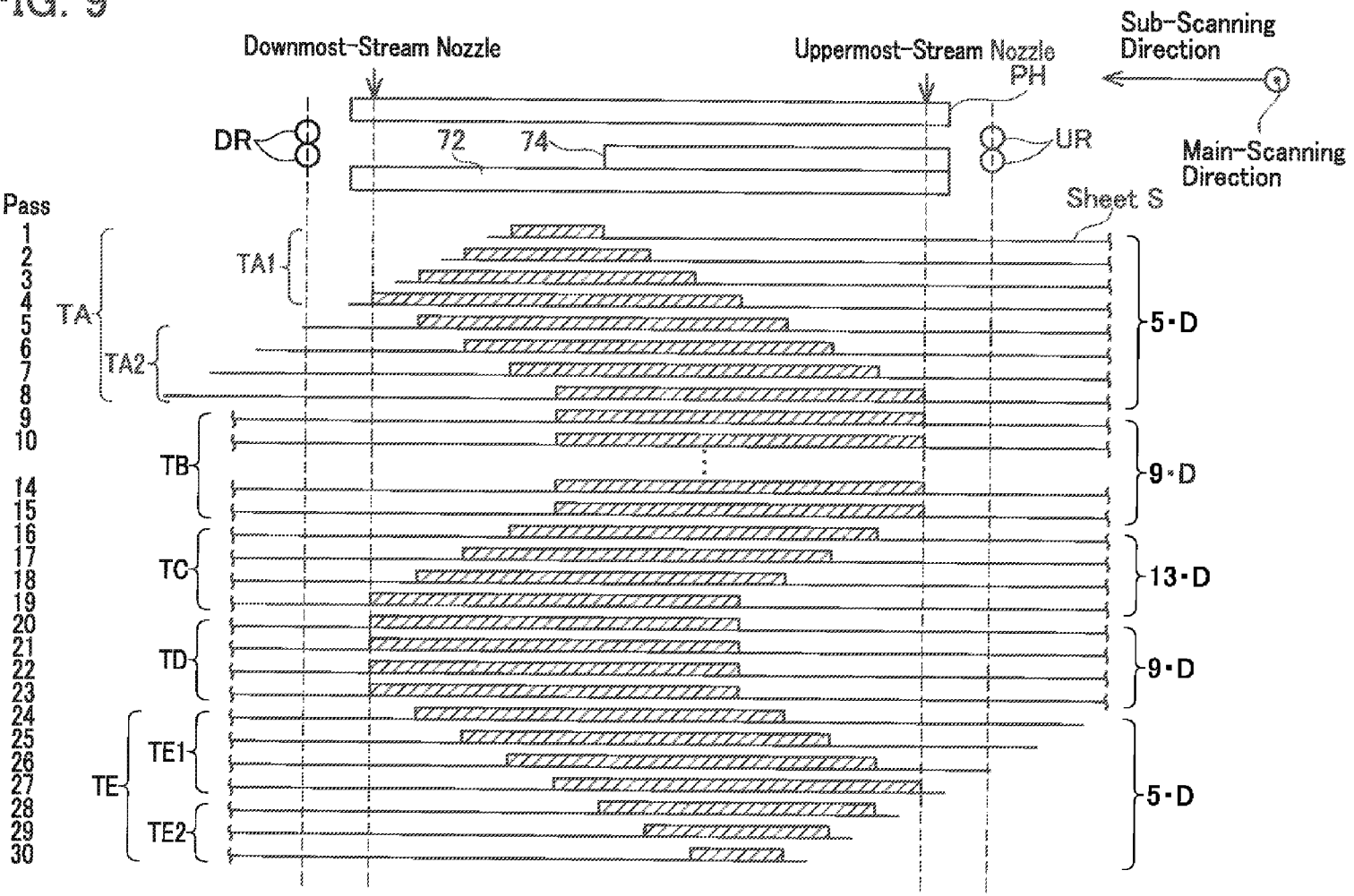
FIG. 9 shows a position of the sheet relative to the printing head in each pass.

The transportation amount $TE_{amount}$ (i.e. small transportation amount) of the section TE is a value in which the shifting amount NS of the position of the usage nozzle group in the section TE is subtracted to the $TD_{amount}$. In the example of FIG. 9, the $TD_{amount}$ and NS are respectively 9·D and 4·D, whereby the $TE_{amount}$ is 5·D.

(Details of Printing; FIG. 9)

FIG. 9 shows how the sheet S moves along the sub-scanning direction with respect to the printing head PH in the printing of FIG. 6 to FIG. 8. Hatching on the sheet S in each pass indicates the position of the usage nozzle group in that pass (i.e. position where dots are to be formed).

In the section TA1 for the $1^{st}$ to $4^{th}$ passes, the sheet S is not supported by the downstream roller pair DR and is supported only by the upstream roller pair UR. In the section TA1, the number of usage nozzles increases sequentially. In the $5^{th}$ pass, the sheet S transitions from the state of not being supported by the downstream roller pair DR to the state of being supported by both the upstream roller pair UR and the downstream roller pair DR. Then, in the section TA2 for the $5^{th}$ to $8^{th}$ passes, the upstream side shifting of the usage nozzle group is performed while the number of usage nozzles is maintained to "9". That is, the upstream side shifting is performed (in other words, started) after having changed from the state where the sheet S is not being supported by the downstream roller pair DR to the state where the sheet S is supported by the downstream roller pair DR.

In the sections TB, TC, TD for the $9^{th}$ to $23^{rd}$ passes, the sheet S is supported by both the upstream roller pair UR and the downstream roller pair DR. In the section TB, the number of usage nozzles is maintained to "9", and the usage nozzle group does not shift. In the section TC, the number of usage nozzles is maintained to "9", and the downstream side shifting of the usage nozzle group is performed. In the section TD, the number of usage nozzles is maintained to "9", and the usage nozzle group does not shift.

In the section TE1 for the $24^{th}$ to $26^{th}$ passes, the sheet S is supported by both the upstream roller pair UR and the downstream roller pair DR. In the section TE1, the upstream side shifting of the usage nozzle group is performed in the state where the number of usage nozzles is maintained to "9". In the $27^{th}$ pass, the sheet S transitions from the state of being supported by both the upstream roller pair UR and the downstream roller pair DR to the state of not being supported by upstream roller pair UR and being supported only by the downstream roller pair DR. That is, the upstream side shifting is performed (in other words, started) before changing from the state where the sheet S is supported by the upstream roller pair UR to the state where the sheet S is not supported by the upstream roller pair UR. In the section TA2, the number of usage nozzles decreases sequentially.

(Creating Scheme for Print Data 160)

Next, contents of process of S18 of FIG. 4 will be explained again. In S18, the CPU 122 creates the print data 160 for performing the printing as described using FIG. 5 to FIG. 9. That is, the CPU 122 creates the transportation amount data indicating 5·D (i.e 5×D) for each of the pass data for the $1^{st}$ to $8^{th}$ passes and the $24^{th}$ to $30^{th}$ passes. The CPU 122 creates the transportation amount data indicating 9·D (i.e. 9×D) for each of the pass data for the $9^{th}$ to $15^{th}$ passes and $20^{th}$ to $23^{rd}$ passes. Further, the CPU 122 creates the transportation amount data indicating 13·D (i.e. 13×D) for each of the pass data for the $16^{th}$ to $19^{th}$ passes. Upon creating each pass data, the CPU 122 further creates pixel data corresponding to each nozzle so that dots are formed by the usage nozzle group shown in FIG. 5 to FIG. 8 in the pass corresponding to the pass data. For example, in the $1^{st}$ pass of FIG. 6, the usage nozzle group is of the nozzle [4] to the nozzle [6], so the respective pixel data corresponding to the nozzle [4] to the nozzle [6] may include "1 (i.e. dot ON)". Notably, the respective pixel data corresponding to other nozzles (for example, nozzle [1]) do not include "1" (i.e. include only "0").

Advantages of First Embodiment

Figure 10:
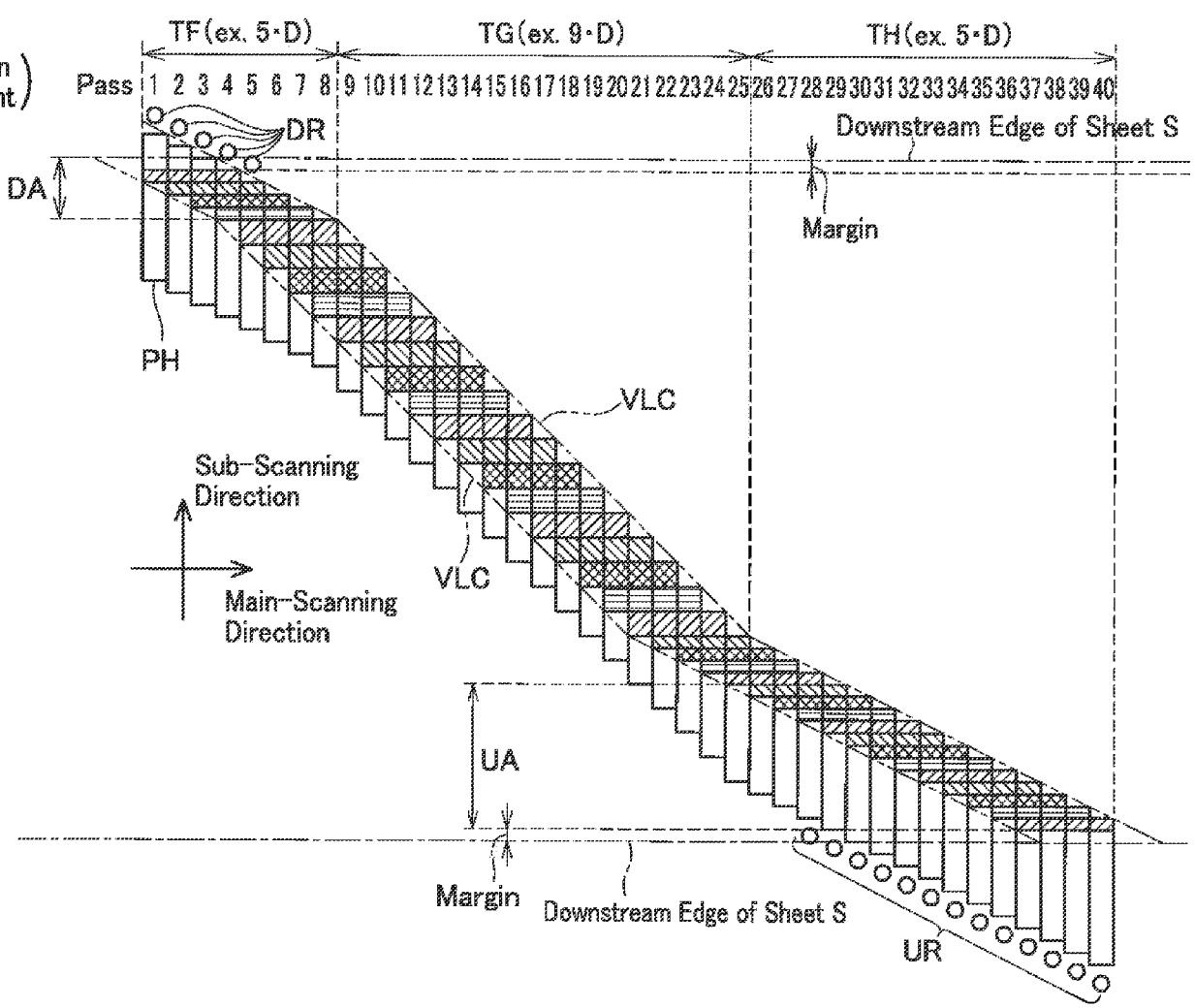
FIG. 10 shows a position of a printing head relative to a sheet in each pass in a comparative example.

FIG. 10 shows contents of printing of a comparative example. In the comparative example, the same target image is printed on a sheet S having the same size as the sheet S shown in FIG. 5 of the present embodiment. In the comparative example, the usage nozzle group does not shift while being in the state where the number of usage nozzles "n" is maintained (i.e. the upstream side shifting and the downstream side shifting are not performed).

The respective transportation amounts of the $1^{st}$ to $8^{th}$ passes of the section TF are the small transportation amount (for example, 5·D). That is, in the $1^{st}$ to $4^{th}$ passes where the sheet S is supported only by the upstream roller pair UR, the small transportation amount that is smaller than the standard transportation amount is employed. Further, in the $5^{th}$ to $7^{th}$ passes for performing the printing in the area DA printed in the $1^{st}$ to $4^{th}$ passes, the small transportation amount is similarly employed. Although the $8^{th}$ pass is irrelevant to the printing of the area DA, the small transportation amount is employed as the transportation amount for the $8^{th}$ pass. This is similar to the $8^{th}$ pass of FIG. 5. In the section TF, the number of usage nozzles increases sequentially. As a result, the, number of usage nozzles comes to be "n" in the $8^{th}$ pass, which is the last pass in the section TF.

The respective transportation amounts of the $9^{th}$ to $25^{th}$ passes of the section TG are the standard transportation amount (for example, 9·D). That is, in the $9^{th}$ to $21^{st}$ passes, the number of usage nozzles "n" is maintained, and the usage nozzle group does not shift. In the $22^{nd}$ to $25^{th}$ passes, the number of usage nozzles decreases sequentially.

The respective transportation amounts of the $26^{th}$ to $40^{th}$ passes of the section TH are the small transportation amount (for example, 5·D). That is, in the $29^{th}$ to $40^{th}$ passes where the sheet S is supported only by the downstream roller pair DR, the small transportation amount that is smaller than the standard transportation amount is employed. Further, in the $26^{th}$ to $28^{th}$ passes for performing the printing in the area UA printed in the $29^{th}$ to $40^{th}$ passes, the small transportation amount is similarly employed. Further, in the $26^{th}$ to $37^{th}$ passes, the number of usage nozzles in the $25^{th}$ pass (i.e. a number of nozzles that is smaller than "n") is maintained. In the $38^{th}$ to $40^{th}$ passes, the number of usage nozzles decreases sequentially.

As described above, in the comparative example, 40 passes are required to print the target image on the sheet S. Compared hereto, in the present embodiment, only 30 passes are required for printing the target image on the sheet S, as shown in FIG. 5. The reason why the number of passes is reduced in the present embodiment is because the upstream side shifting is performed while the number of usage nozzles is maintained to "n" in the section TA2 for printing the downstream edge area DEA and the section TE1 for printing the upstream edge area UEA. That is, in the section TA2 and the section TE1, the sheet S is transported by the small transportation amount, however, the number of usage nozzles is equal to the number of usage nozzles "n" in the respective sections TB, TC, TD for printing the corresponding central areas CAB, CAC, CAD. Thus, the present embodiment requires less number of passes as compared to the comparative example, and as a result, the printing of the target image can be performed at high speed.

Further, as shown by the two lines of two-dots chain lines VLC in FIG. 10, in the comparative example, a polygonal line is formed when the respective uppermost-stream nozzles in each of the usage nozzle groups in each pass are connected, and a polygonal line is formed when the respective downmost-stream nozzles are connected. Contrary to this, as shown by the two lines of two-dots chain lines VL1 in FIG. 5, in the present embodiment, two straight lines are formed when similar connections are made. Accordingly, the reason why such two straight lines are formed can be said as being due to the upstream side shifting taking place in the section TA2 and the section TE1 while being in the state of maintaining the number of usage nozzles to "n".

(Correspondence Relationship)

The printer PR and the terminal device TR are respectively examples of "print performing unit" and "control device". The sub-scanning direction and the main-scanning direction are respectively examples of "first direction" and "second direction". In FIG. 5, the downstream edge area DEA, the central area CAB, the central area CAC, the central area CAD, and the upstream edge area UEA are respectively examples of "first edge area", "second central area", "first central area", "third central area", and "second edge area". The pass data for the $1^{st}$ to $8^{th}$ passes of the section TA, the pass data for the $9^{th}$ to $15^{th}$ passes of the section TB, the pass data for the $16^{th}$ to $19^{th}$ passes of the section TC, the pass data for the $20^{th}$ to $23^{rd}$ passes of the section TD, and the pass data for the $24^{th}$ to $30^{th}$ passes of the section TE are respectively examples of "first edge print data", "second central print data", "first central print data", "third central print data", and "second edge print data". The 4 times of main-scanning actions in the section TA2, the 7 times of main-scanning actions in the section TB, the 4 times of main-scanning actions in the section TC, the 4 times of main-scanning actions in the section TD, and the 4 times of main-scanning actions in the section TD are respectively examples of "M1 times of the first type of main-scanning actions", "M4 times of the fourth type of main-scanning actions", "M2 times of the second type of main-scanning actions", "M5 times of the fifth type of main-scanning actions", and "M3 times of the third type of main-scanning actions". Further, the $TA_{amount}$, the $TC_{amount}$, and the $TE_{amount}$ are respectively examples of "first transportation amount", "second transportation amount", and "third transportation amount".

Further, the central area CAB (or the central area CAD) may be considered as being an example of "first central area". In this case, the pass data for the $9^{th}$ to $15^{th}$ passes of the section TB (or pass data for the $20^{th}$ to $23^{rd}$ passes of the section TD) are an example of "first central print data". The 7 times of main-scanning actions of the section TB (or 4 times of main-scanning actions of the section TD) are an example of "M2 times of the second type of main-scanning actions". Further, the $TB_{amount}$ (or the transportation amount $TD_{amount}$) is an example of "second transportation amount".

Further, the upstream edge area UEA may be considered as being an example of "first edge area". In this case, the pass data for the $24^{th}$ to $30^{th}$ passes of the section TE are an example of "first edge print data". The 4 times of main-scanning actions of the section TE1 is are an example of "M1 times of the first type of main-scanning actions". Further, the $TE_{amount}$ is an example of "first transportation amount".

Second Embodiment

FIG. 11

Figure 11:
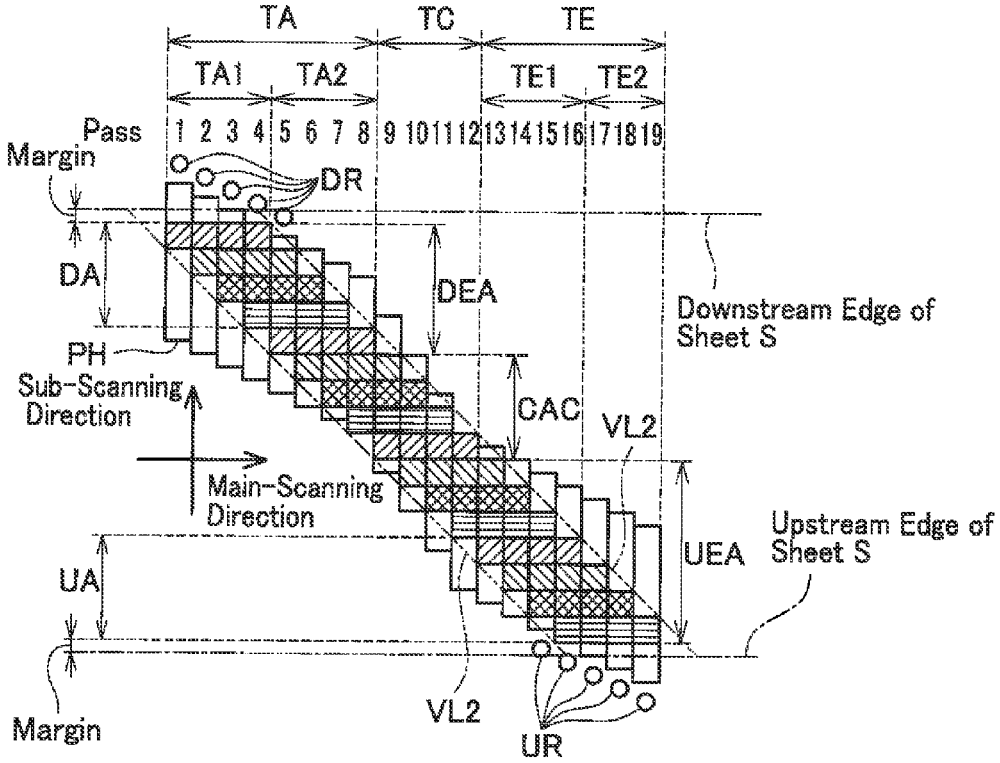
FIG. 11 shows a position of a printing head relative to a sheet in each pass in a second embodiment.

In the present embodiment, in a case where a size of a target image in the sub-scanning direction is relatively small, the CPU 122 of the terminal device TR creates, in S18 of FIG. 4, print data for causing the printer PR to perform printing which does not include a section (see sections TB, TD in FIG. 5) in which the sheet S is transported by the standard transportation amount. Due to this, printing of FIG. 11 is performed in the printer PR. FIG. 11 shows how the printing head PH relatively moves along the sub-scanning direction with respect to the sheet S in each pass of the present embodiment. Sections TA, TC, TE are the same as the sections TA, TC, TE in FIG. 5.

According to the present embodiment, in the sections TA2, TE1, the sheet S is transported by the small transportation amount, and the number of usage nozzles in these sections is equal to the number of usage nozzles "n" in the section TC for printing the central area CAC. Therefore, printing of the target image can be performed in high-speed. In addition, also in the present embodiment, as shown in the two lines of two-dots chain lines VL2, a straight line is formed by connecting each of downmost-stream nozzles in the respective usage nozzle groups in each pass, while a straight line is formed by connecting each of uppermost-stream nozzles in the respective usage nozzles in each pass, respectively. In the present embodiment, the downstream edge area DEA, the central area CAC, the upstream edge area UEA are examples of "first edge area", "first central area", and "second edge area", respectively.

Modification No. 1 in Second Embodiment

In S18 of FIG. 4, in a case where the size of a target image in the sub-scanning direction is larger than that of the second embodiment, the CPU 122 of the terminal device TR may further create print data for causing the printer PR to perform printing of a section TB (see FIG. 5) where the sheet S is transported by the standard transportation amount, the section TB being additionally inserted between the section TA and the section TC of FIG. 11. In the present modification, the downstream edge area DEA, the central area CAB (see FIG. 5), the central area CAC, the upstream edge area UEA are examples of the "first edge area", "second central area", "first central area", and "second edge area", respectively.

Modification No. 2 in Second Embodiment

In S18 of FIG. 4, in a case where the size in the sub-scanning direction of a target image is larger than that of the second embodiment, the CPU 22 of the terminal device TR may for example create print data for causing the printer PR to perform printing of a section TD (see FIG. 5) where the sheet S is transported by the standard transportation amount, the section TD being additionally inserted between the section TC and TE of FIG. 11. In the present modification, the downstream edge area DEA, the central area CAC, the central area CAD (see FIG. 5), and the upstream edge area UEA are examples of "first edge area", "first central area", "third central area", and "second edge area", respectively.

Third Embodiment

FIG. 12

Figure 12:
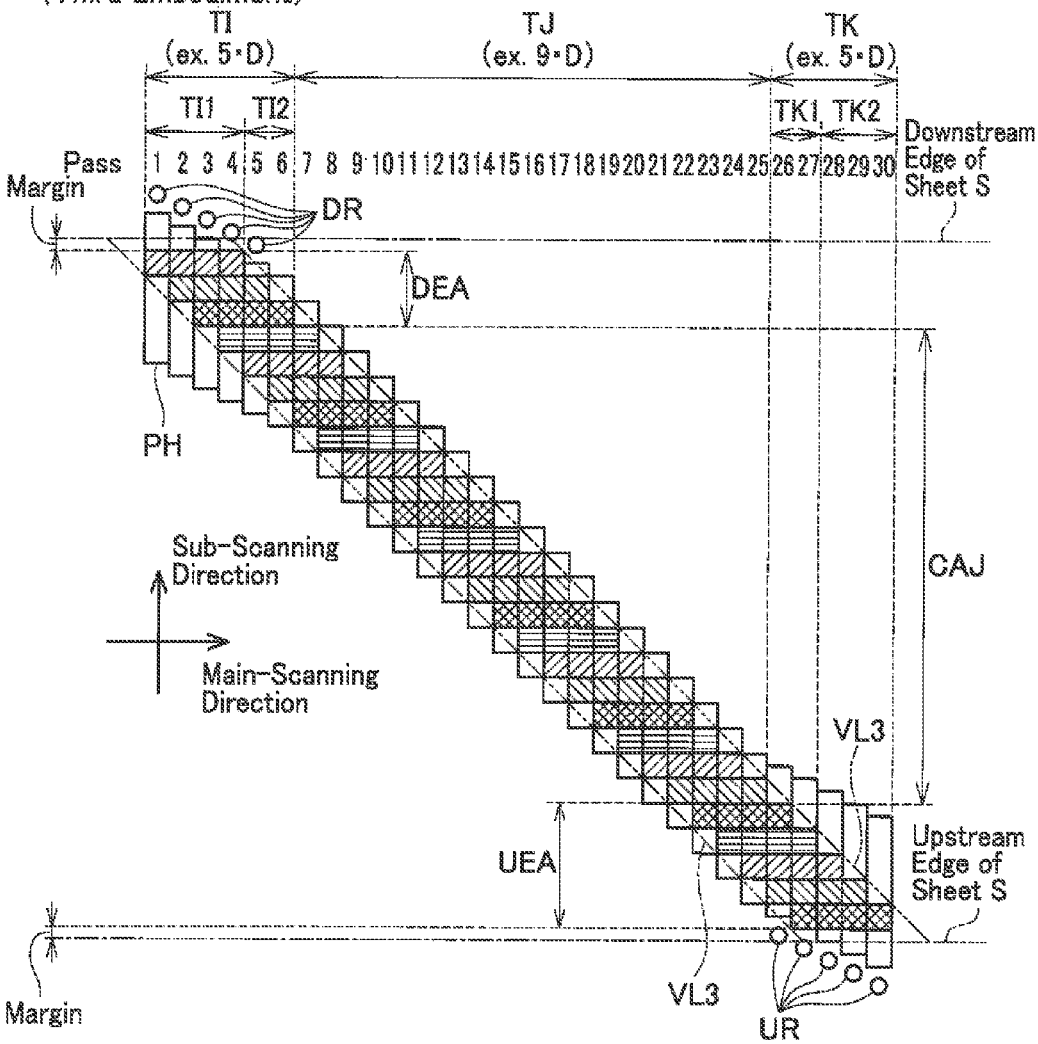
FIG. 12 shows a position of a printing head relative to a sheet in each pass in a third embodiment.

In the present embodiment, in S18 of FIG. 4, the CPU 122 of the terminal device TR creates print data for causing the printer PR to perform printing which does not include a section (for example, section TC of FIG. 5) where the sheet S is transported by the large transportation amount. Due to this, printing of FIG. 12 is performed in the printer PR. FIG. 12 shows how the printing head PH moves along the sub-scanning direction relatively to the sheet S in each pass of the present embodiment. The printing of FIG. 12 is divided into a section TI where the sheet S is transported by the small transportation amount, a section TJ where the sheet S is transported by the standard transportation amount, and a section TK where the sheet S is transported by the small transportation amount.

In a section TI1 among the section TI, the number of usage nozzles is sequentially increased. In $4^{th}$ pass, the usage nozzle group includes the downmost-stream nozzle, and the number of usage nozzles is "n". In a section TI2 among the section TI, the number of usage nozzles is maintained to "n", and the upstream side shifting is performed twice. In $6^{th}$ pass, the usage nozzle group does not include the uppermost-stream nozzle or the downmost-stream nozzle. That is, the usage nozzle group in the $6^{th}$ pass only includes a nozzle group (hereinbelow referred to as "center nozzle group") positioned at a center in the sub-scanning direction among the N pieces of nozzles NZ formed on the printing head PH. In each pass in the section TI, a downstream edge image, which is a part of the target image, is formed in a downstream edge area DEA on the sheet S. Especially, printing for the $5^{th}$ to $6^{th}$ passes is printing which satisfies: performing the transportation of the sheet S by the small transportation amount for twice; maintaining the number of usage nozzles to "n" in 2 times of main-scanning actions which are performed after the 2 times of the transportations; and performing upstream side shifting.

In a section TJ, the number of usage nozzles is maintained to "n". Further, in the section TJ, since the usage nozzle group does not shift, the usage nozzle group only includes the center nozzle group. Notably, an area printed in $7^{th}$ pass includes an area printed in $1^{st}$ to $4^{th}$ passes where the sheet S is supported only by the upstream roller pair UR. However, in the present embodiment, in order to perform the printing of FIG. 12, the small transportation amount is not employed but the standard transportation amount is employed in the $7^{th}$ pass. Further, an area printed in $24^{th}$ to $25^{th}$ passes includes an area printed in $27^{th}$ to $30^{th}$ passes where the sheet S is supported only by the downstream roller pair DR, and the standard transportation amount is employed in the $24^{th}$ to $25^{th}$ passes. Such implementation of the standard transportation amount also applies to a fourth embodiment (see FIG. 13) to be described later. A central image, which is a part of the target image, is formed in a central area CAJ located at a center of the sub-scanning direction on the sheet S by each pass in the section TJ. Printing in the section TJ is printing which satisfies: performing the transportation of the sheet S by the standard transportation amount for 19 times, maintaining the number of usage nozzles to "n" in 19 times of the main-scanning actions which are performed after the 19 times of the transportations, and not shifting of the usage nozzle group.

In a section TK1 among the section TK, the number of usage nozzles is maintained to "n", and the upstream side shifting is performed twice. In $27^{th}$ pass, the usage nozzle group includes the uppermost-stream nozzle. In a section TK2 among the section TK, the number of usage nozzles sequentially decreases. Each pass in the section TK forms an upstream edge image, which is a part of the target mage, in the upstream edge area UEA on the sheet S. Especially, printing for the $26^{th}$ to $27^{th}$ passes in the section TK1 is printing which satisfies: performing the transportation of the sheet S by the small transportation amount twice, maintaining the number of usage nozzles to "n" in 2 times of the main-scanning actions which are performed after the 2 times of transportations, and performing the upstream side shifting.

A transportation amount $TJ_{amount}$ (i.e. standard transportation amount) in the section TJ is n·D. A transportation amount $TI_{amount}$ (i.e. small transportation amount) in the section TI is a value calculated by subtracting, from the $TJ_{amount}$, a shifting amount NS of the position of usage nozzle group in the section TI. Similarly, a transportation amount $TK_{amount}$ (i.e. small transportation amount) in the section TK is a value calculated by subtracting, from the $TJ_{amount}$, a shifting amount NS of the position of usage nozzle group in the section TK. Moreover, as shown in two lines of two-dots chain lines VL3, in the present embodiment also, a straight line is formed by connecting each of uppermost-stream nozzles in the respective usage nozzle groups in each pass, while a straight line is formed by connecting each of downmost-stream nozzles in the respective usage nozzles in each pass, respectively.

Normally, in the printing head PH, discharging accuracy of each edge nozzle group located on the upstream side and the downstream side in the sub-scanning direction tends to be inferior to discharging accuracy of the center nozzle group located at the center of the sub-scanning direction. As mentioned above, in the present embodiment, all of the edge nozzle groups are not used upon executing printing of the central area CAJ, and only the center nozzle group is used therein. Further, transportation accuracy of the sheet S is higher because the sheet S is supported by both of the upstream roller pair UR and the downstream roller pair DR upon executing printing of the central area CAJ. Thus, in the present embodiment, high image quality printing can be performed since the center nozzle group having the higher discharging accuracy is used in a state where the transportation accuracy of the sheet S is high.

Moreover, according to the present embodiment, in the sections TI2, TK1 the sheet S is transported by the small transportation amount, and the number of usage nozzles is equal to the number of usage nozzles "n" in the section TJ for printing the central area CAJ. Therefore, printing of the target image can be performed in high-speed. Thus, printing of the target image can be performed in high-speed and also high image quality printing of the central area CAJ can be also performed. In the present embodiment, the downstream edge area DEA, central area CAJ, upstream edge area UEA are examples of "first edge area", "first central area", and "second edge area", respectively.

Fourth Embodiment

FIG. 13, FIG. 14

Figure 13:
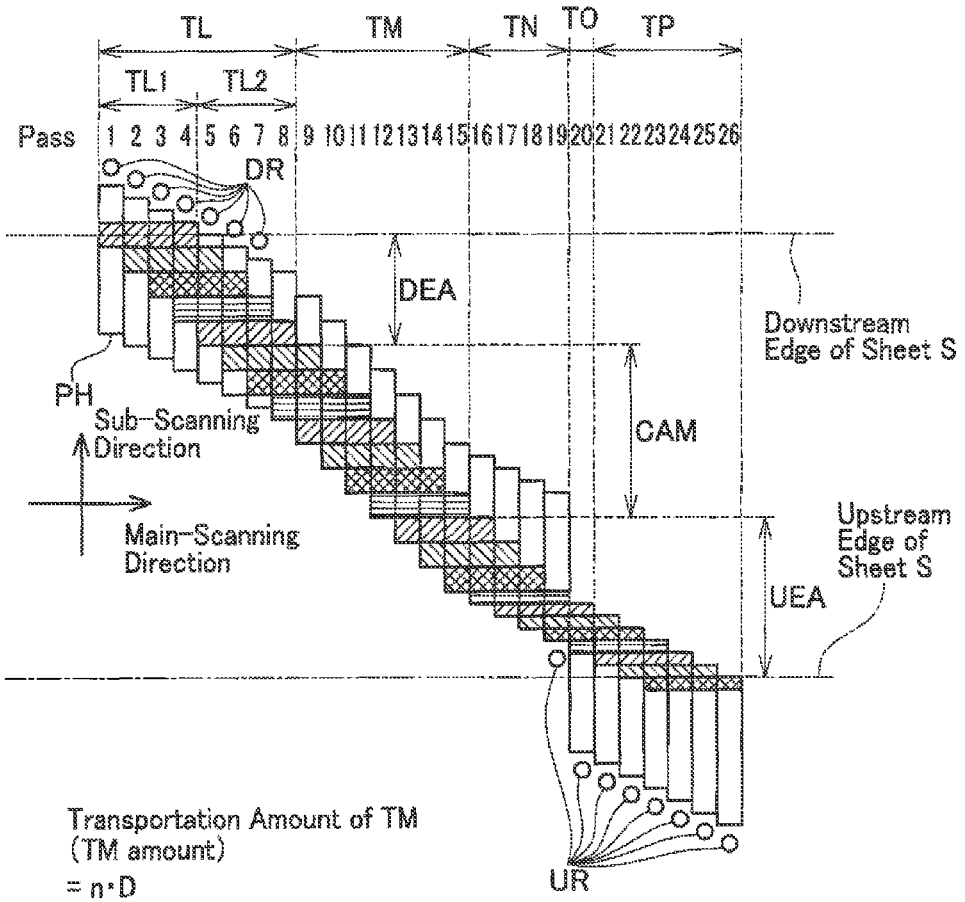
FIG. 13 shows a position of a printing head relative to a sheet in each pass in a fourth embodiment.

In the present embodiment, in S12 of FIG. 4, the CPU 122 of the terminal device TR creates converted image data representing a converted image CI having a longer length than a length of the sheet S in the sub-scanning direction. That is, the converted image data is data for printing (i.e. so-called no-margin printing) in which a margin cannot be provided in each edge of the sheet S at the upstream side and the downstream side respectively in the sub-scanning direction. In this case, in S18, the CPU122 creates print data for causing the printer PR to perform the no-margin printing. Moreover, the CPU creates print data for causing the sheet S to be transported by a transportation amount (hereinbelow referred to as "extra-large transportation amount") which is significantly larger than the standard transportation amount, upon executing printing of the upstream edge area UEA (see FIG. 13) on the sheet S. Due to this, printing of FIG. 13 is performed. FIG. 13 shows how the printing head PH moves along the sub-scanning direction relatively to the sheet S in each pass of the present embodiment.

A section TL (that is, sections TL1 and TL2) is the same as the section TA (that is, sections TA1, TA2) of FIG. 5. However, each usage nozzle group in $1^{th}$ to $4^{th}$ passes in the section TL1 includes a nozzle group located downstream (i.e. upper) than the downstream edge of the sheet S. Due to this, even if the sheet S is undesirably transported to a position slightly more towards the downstream side than a target position, the no-margin printing can be performed appropriately at the downstream edge of the sheet S. In each pass in the section TL, a downstream edge image, which is a part of a target image, is formed in the downstream edge area DEA on the sheet S. Especially, printing for the $5^{th}$ to $8^{th}$ passes in the section TL2 is printing which satisfies: performing the transportation of sheet S by the small transportation amount for 4 times, maintaining the number of usage nozzles to "n" in 4 times of main-scanning actions which are performed after the 4 times of transportations, and performing the upstream side shifting.

A section TM is the same as the section TB of FIG. 5. In each pass in the section TM, a central image, which is a part of the target image, is formed in a central area CAM of the sheet S. Printing of the section TM is printing which satisfies: performing the transportation of the sheet S by the standard transportation amount for 7 times, maintaining the number of usage nozzles to the "n" in 7 times of main-scanning actions which are performed after the 7 times of sheet S transportations, and not shifting of usage nozzle group.

In a section TN, the sheet S is transported by the small transportation amount and the number of usage nozzles is sequentially decreased. That is, the number of usage nozzles in the section TN is "n" or less. Moreover, in a section TO, the sheet S is transported by the extra-large transportation amount. Due to this, the sheet S changes from a state of being supported by both of the upstream roller pair UR and downstream roller pair DR, to a state of being supported only by the downstream roller pair DR. The number of usage nozzles in $20^{th}$ pass of the section TO is equal (i.e. less than "n") to the number of usage nozzles in $19^{th}$ pass.

In a section TP, the sheet S is transported by the small transportation amount. Each number of usage nozzles in $21^{st}$ to $23^{th}$ passes in the section TP is equal (that is, less than "n") to the number of usage nozzles in $20^{th}$ pass. The number of usage nozzles is sequentially decreased in $24^{th}$ to $26^{th}$ passes in the section TP. Further, each usage nozzle group in the $24^{th}$ to $26^{th}$ passes in the section TP includes a nozzle group located more towards the upstream (i.e. lower) side than the upstream edge of the sheet S. Due to this, even if the sheet S is undesirably transported to a position which is slightly more towards the upstream side than a target position, the no-margin printing can be performed appropriately in the upstream edge of the sheet S. In each pass in the sections TN, TO and TP, an upstream edge image, which is a part of the target image, is formed in the upstream edge area UEA on the sheet S.

Figure 14:
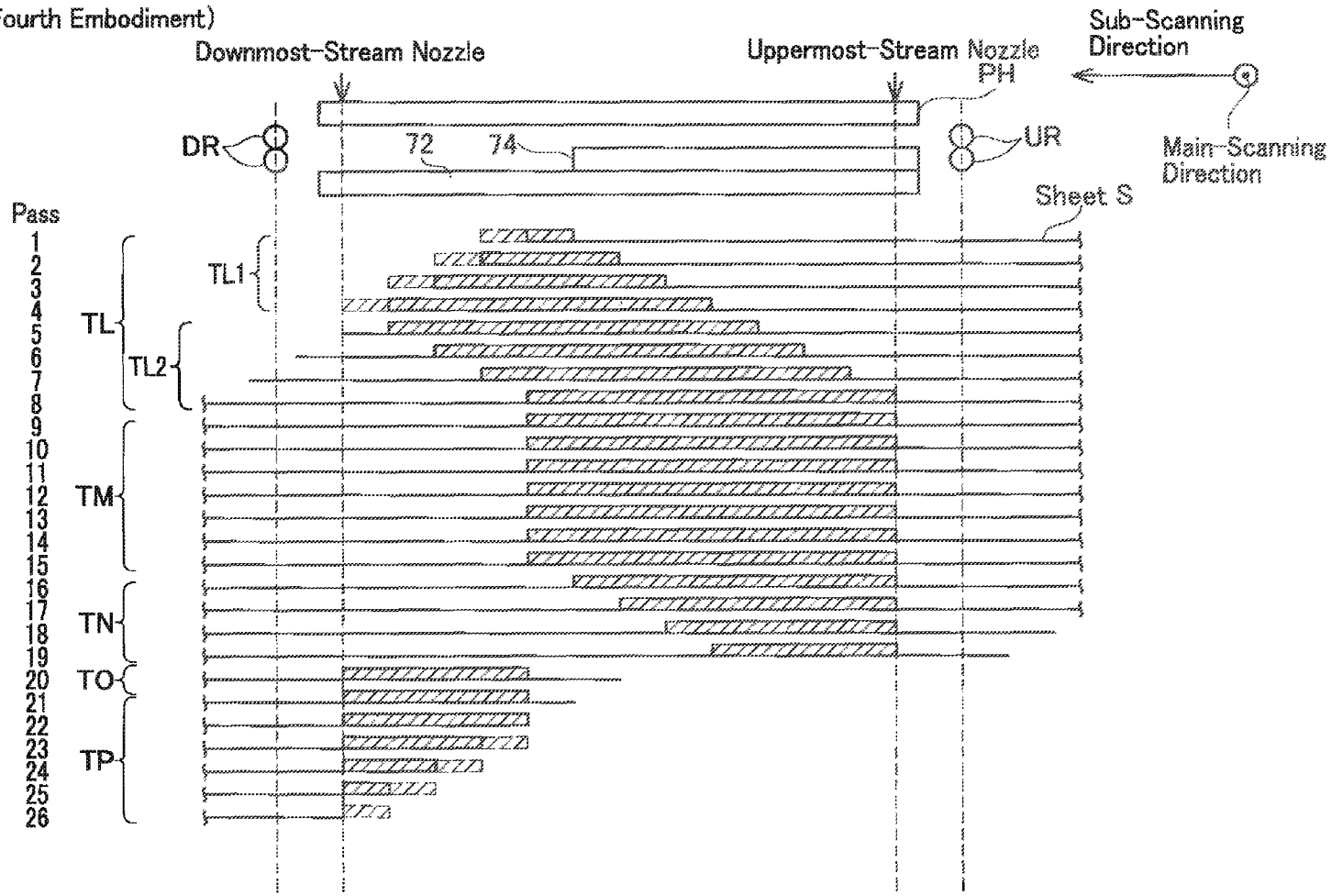
FIG. 14 shows a position of the sheet relative to the printing head in each pass in the fourth embodiment.

FIG. 14 shows how the sheet S moves along the sub-scanning direction relatively to the printing head PH in the printing of FIG. 13. Solid line hatching and broken line hatching in each pass indicate a position of the corresponding usage nozzle group in each pass. Specifically, the solid line hatching and broken line hatching respectively indicate an area printed by the usage nozzle group and an area not printed by the usage nozzle group in a case where the sheet S is transported correctly to a corresponding target position. For example, when the sheet S is transported to the target position in the $1^{st}$ pass, ink discharged by a downstream nozzle group located downstream, which is indicated in broken line, is not applied onto the sheet S (i.e. the downstream nozzle group does not perform printing). However, for example, if the sheet S is transported to a position slightly more towards the downstream side than (i.e. on a left side of) the target position in the $1^{st}$ pass, the ink discharged by the above-mentioned downstream nozzle group is applied onto the sheet S. Due to this, no-margin printing can be appropriately performed.

As shown by the broken line hatching in $1^{st}$ to $4^{th}$ passes, there is a possibility that the ink discharged by a downstream nozzle group among the usage nozzle group may not be applied onto the sheet S. However, the above-mentioned downstream nozzle group is located at a downstream side than a downstream edge (that is, left edge) of platens 74. Therefore, it is possible to suppress ink discharged by the above-mentioned downstream nozzle group from contaminating the platens 74, i.e., from contaminating the sheet S supported by the platens 74. This point is also applied to 23 to $26^{th}$ passes, and although there is a possibility that ink discharged by an upstream nozzle group located upstream among the usage nozzle group may not be applied onto the sheet S, the above-mentioned upstream nozzle group is located at the downstream side than the downstream edge of the platens 74. Accordingly, it is possible to suppress the ink discharged by the above-mentioned upstream nozzle group from contaminating the platens 74.

According to the present embodiment, the sheet S is transported by the extra-large transportation amount in the section TO. Reasons of this are as follows. For example, a case will be supposed in which, after $19^{th}$ pass, the sheet S is transported by a relatively small transportation amount such as the standard transportation amount instead of the extra-large transportation amount. In this case, a length of a part of the sheet S located at the upstream side than (i.e. a right side of) the downstream roller pair DR becomes large in the sub-scanning direction when changing from a state where the sheet S is supported by the upstream roller pair UR to a state where the sheet S is not supported by the upstream roller pair UR. If the length of part of the sheet S is thus large, an upward deformation degree in the upstream edge of the sheet S becomes great when such upward deformation of the upstream edge of the sheet S occurs. As a result, there is a possibility that the upstream edge of the sheet S may make contact with the lower surface (i.e. the surface on which the nozzles NZ are mounted) of the printing head PH such that the sheet S is contaminated, when the printing head PH moves along the main-scanning direction. Contrary to this, if the sheet S is transported by the extra-large transportation amount after the $19^{th}$ pass as in the present embodiment, it is possible to minimize the length of the part of the sheet S located more towards the upstream side than the downstream roller pair DR. Due to this, even if such upward deformation of the upstream edge of the sheet S occurs, it is possible to suppress the upstream edge of the sheet S from contacting the lower surface of the printing head PH, due to the deformation degree being small. As a result, the contamination of the sheet S may be suppressed.

In the meantime, in order to perform interlace printing, in a pass ($20^{th}$ pass in example of FIG. 13, hereinafter referred to as 'extra-large transportation pass') where the sheet S is transported by the extra-large transportation amount, printing needs to be performed again onto a printing area which was printed in a pass just before this extra-large transportation pass. Accordingly, a value of the extra-large transportation amount is set within a range so that the printing of the printing area of the pass just before the extra-large transportation pass is possible. Further, if the value of the extra-large transportation amount can be set large, it is possible to appropriately minimize the length of part of the sheet S located more upstream than the downstream roller pair DR after the sheet S is transported by the extra-large transportation amount. Due to this, even if the upward deformation of the upstream edge of the sheet S occurs, the upstream edge of the sheet S can be appropriately prevented from contacting the lower surface of the printing head PH, as a result of which the sheet S can be appropriately suppressed from being contaminated. If a configuration in which an upstream side shifting is not performed in the section TL2, e.g., configuration in which a center nozzle group located at the center of the sub-scanning direction among the N pieces of nozzles NZ is only used, is adopted, the center nozzle group can be used also in the sections TM and TN after the section TL2. In this case, the value of the extra-large transportation amount cannot be set but relatively small because, in the extra-large transportation pass where the sheet S is transported by the extra-large transportation amount, it is necessary to print an area which was printed by the center nozzle group in a pass just before this ongoing extra-large transportation pass. Contrary to this, since the upstream side shifting is performed in the section TL2 in the present embodiment, the upstream nozzle group among the N pieces of nozzles NZ is only used in the sections TM and TN after the section TL2. Thus, since the upstream nozzle group is only used in $19^{th}$ pass, the value of the extra-large transportation amount can be set large in $20^{th}$ pass. Due to this, the sheet S can be appropriately suppressed from being contaminated.

Further, according to the present embodiment, although the sheet S is transported by the small transportation amount in the section TL2, the number of usage nozzles in the section TL2 is equal to the number of usage nozzles "n" in the section TM for printing the central area CAM. Accordingly, while the sheet S can be suppressed from being contaminated, printing of the target image can be performed in high-speed. In the present embodiment, the downstream edge area DEA and the central area CAM are examples of the "first edge area" and "first central area", respectively.

Fifth Embodiment

FIG. 15

In the above first to fourth embodiments, the print resolution of the sub-scanning direction is a print resolution for forming a plurality of rasters within a length of one nozzle pitch (i.e. interlace printing is performed) on the sheet S. Instead of this, in the present embodiment, the print resolution of the sub-scanning direction is a print resolution for forming one raster within the length of one nozzle pitch on the sheet S. Especially, this one raster is formed by 4 times of main-scanning actions. Printing of forming one raster by the 4 times of main-scanning actions as in the present embodiment is called "four-pass shingling printing." It should be advised herein that, in a modification, the print resolution of the sub-scanning direction may be a print resolution for performing a shingling printing of a number of passes other than 4 passes.

Figure 15:
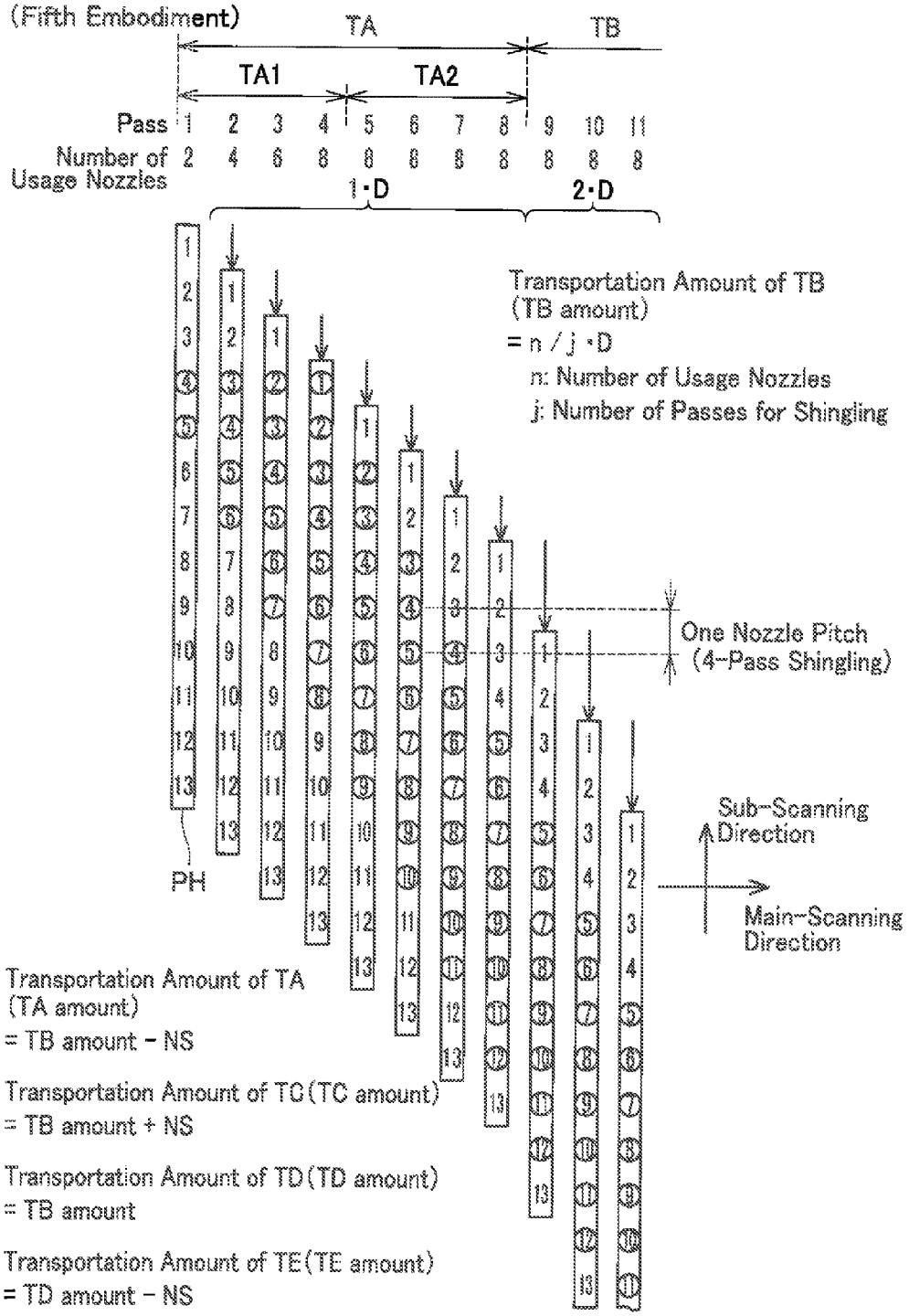
FIG. 15 shows how printing is performed for $1^{st}$ pass to $11^{th}$ pass of a fifth embodiment.

FIG. 15 shows how the printing head PH moves along the sub-scanning direction relatively to the sheet S. A distance within one nozzle pitch is indicated between nozzle [4] and nozzle [5] in $6^{th}$ pass. In a same location in the sub-scanning direction between this distance, ink is discharged from nozzle [7] in $3^{th}$ pass, nozzle [6] in $4^{th}$ pass, nozzle [5] in $5^{th}$ pass, and nozzle [4] in $6^{th}$ pass. Due to this, one raster is formed by four times of main-scanning actions so as to perform the 4-pass shingling printing. Notably, forming one raster within one nozzle pitch means that the one nozzle pitch is equal to 1·D.

In a section TA1 in $1^{st}$ to $4^{th}$ passes, the number of usage nozzles is sequentially increased from "2" to "4" to "6", and then to "8". In a section TA2 in $5^{th}$ to $8^{th}$ passes, the upstream side shifting of the usage nozzle group is performed while the number of usage nozzles is maintained to "8". In the $5^{th}$ to $8^{th}$ passes, each shift amount NS of the location of the usage nozzle group is one nozzle pitch (i.e. 1·D). Also, in a section TB of $9^{th}$ to $11^{th}$ passes, the number of usage nozzles is maintained to "8" and the shift of the usage nozzle group is not performed.

A $TB_{amount}$ (i.e. the standard transportation amount) is a transportation amount for performing printing in a predetermined resolution by a plurality of times of main-scanning actions in a state where the sheet S is transported by a constant transportation amount; the number of usage nozzles is maintained to "8"; and no shifting of the usage nozzle group is performed. In a case where the shingling printing is performed, the $TB_{amount}$ is n/j·D when the number of usage nozzles is "n". At this occasion, the j is a number of passes required for shingling. In an example of FIG. 15, since n=8 and j=4, the $TB_{amount}$ is 2·D (i.e. (8/4)·D).

A $TA_{amount}$ (i.e. small transportation amount) is a value calculated by subtracting, from the $TB_{amount}$, the shifting amount NS of the position of the usage nozzle group in the section TA2, Since, in the example of FIG. 15, the $TB_{amount}$ and the NS are 2·D and 1·D, respectively, the $TA_{amount}$ is 1·D. Although these are not shown, a transportation amount of each section TC, TD, TE (see FIG. 5) is as follows. That is, a $TC_{amount}$ (i.e. large transportation amount) is 3·D, which is a value calculated by adding, to the $TB_{amount}$ (i.e. 2·D), the shifting amount NS (i.e. 1·D) of the position of the usage nozzle group in the section TC. A $TD_{amount}$ is 2·D, equal to the $TB_{amount}$. Further, a $TE_{amount}$ (i.e. small transportation amount) is 1·D, which is a value calculated by subtracting, from the $TD_{amount}$ (i.e. 2·D), the shift amount NS (i.e. 1·D) of the position of the usage nozzle group in the section TE1 (see FIG. 5). In the present embodiment, the 4-pass shingling printing can be performed in high-speed.

(Summary on Standard Transportation Amount)

In the fifth embodiment, one raster is formed by a plurality of (i.e. four) times of the main-scanning actions within the length of one nozzle pitch. Alternatively, one raster may be formed by one time of the main-scanning action within the length of one nozzle pitch (hereinbelow referred to as "normal printing"). In the normal printing, the standard transportation amount is n·D. Further, in the interlace printing of the first embodiment, a plurality of (i.e. four) rasters is formed within the length of one nozzle pitch by a plurality of (i.e. four) times of the main-scanning actions. Herein, in focusing on one raster, this one raster is formed by one time of the main-scanning action. In the interlace printing, the standard transportation amount is n·D. Generally, a standard transportation amount for forming one raster by j times (j being an integer equal to or more than 1) of main-scanning action is expressed as n/j·D. Herein, the j is a divisor of the n. In the interlace printing of the first embodiment (i.e. n=9, j=1; see FIG. 6), the standard transportation amount is 9·D (i.e. (9/1)·D). In the shingling printing of the fifth embodiment (i.e. n=8, j=4; see FIG. 15), the standard transportation amount is 2·D (i.e. (8/4)·D). In the above-mentioned normal printing (i.e. j=1), in a case where n=8, the standard transportation amount is 8·D (i.e. (8/1)·D).

Further, generally, a standard transportation amount for forming k rasters (k being an integer equal to or more than 1) within the length of one nozzle pitch by k×j times of the main-scanning actions, is indicated as (k×X+b)·D. Herein, the j is a number of times of the main-scanning actions required for forming one raster. Also, each of the b and the X is an integer satisfying (Equation 1) "$-(1/2)\times k<b\leq(1/2)\times k$" and (Equation 2) "$n=(k\times X+b)\times j$". In the interlace printing of the first embodiment (see FIG. 6), k=4, j=1, and, n=9 are set. According to (Equation 1), b=−1, 0, 1, or, 2 is obtained. Further, according to (Equation 2), "$9=(4\times X+b)\times 1$" is obtained. Accordingly, X=2 and b=1 are obtained. Thus, the standard transportation amount is 9·D (that is, (4×2+1)·D). In the shingling printing of the fifth embodiment (see FIG. 15), k=1, j=4, and n=8 are obtained. According to (Equation 1), b=0 is obtained. Also, according to (Equation 2), "$8=(1\times X+0)\times 4$" is obtained. Accordingly, X=2 is obtained. Consequently, the standard transportation amount is 2·D (that is, (1×2+0)·D). In the normal printing, k=1 and j=1 are obtained. According to (Equation 1), b=0 is obtained. Also, in a case where n=8, according to (Equation 2), "$8=(1\times X+0)\cdot 1$" is obtained. Accordingly, X=8 is obtained. Consequently, the standard transportation amount is 8·D (i.e. (1×8+0)·D).

Further, a case is supposed where 4-pass interlace printing and 2-pass shingling printing are jointly performed. In this case, k=4 and j=2 are set, and four rasters are formed within the length of one nozzle pitch by eight times (that is, 4×2) of the main-scanning actions. According to (Equation 1), b=−1, 0, 1, or 2. Further, in a case where n=18 for example, according to (Equation 2), "$18=(4\times X+b)\times 2$". Accordingly, X=2, b=1 are obtained. Consequently, the standard transportation amount is 9·D (that is, (4×2+1)·D).

Modification 1

In the above embodiments, a roller pair including a driving roller and a driven roller is employed as each of the upstream roller pair UR and the downstream roller pair DR. However, the driven roller may be omitted. In this case, the driving roller may support the sheet S in cooperation with a member including a flat surface. That is, each of "the upstream roller pair UR" and the "downstream roller pair DR" may be configured by at least one roller.

Modification 2

In the above embodiments, the CPU 122 of the terminal device TR creates the print data 160 and supplies the print data 160 to the printer PR (see FIG. 4). Alternatively, the control circuit 20 (specifically, a CPU not shown) of the printer PR may obtain a print instruction including image data from the terminal device TR, and use this image data so as to perform processes from S12 to S18 in FIG. 4 and create the print data 160. In this case, the control circuit 20 controls the printing engine PE by supplying the print data 160 to the printing engine PE. In the present modification, the printing engine PE and the control circuit 20 in the printer PR are examples of the "print performing unit" and "control device", respectively.

Modification 3

In the above embodiments, each of the process of FIG. 4 is achieved by the CPU 122 of the terminal device TR executing the printer driver 126 (that is software). Alternatively, at least one process in the processes of FIG. 4 may be performed by hardware such as a logic circuit.

The invention claimed is:

1. A control device configured to cause a print performing unit to perform printing, wherein the print performing unit comprises:

a printing head comprising N nozzles which align along a first direction, the N being an integer equal to or more than 2;

a medium transportation unit configured to transport a print medium from an upstream side to a downstream side along the first direction; and a head driving unit configured to cause the printing head to perform a main-scanning action, the main-scanning action including an action for causing the printing head to discharge ink toward the print medium while causing the printing head to move along a second direction which is perpendicular to the first direction, the control device comprising:

a processor; and a memory storing computer-readable instructions which, when performed by the processor, cause the control device to:

obtain image data representing a target image;

create print data using the image data, the print data being for causing the print performing unit to perform printing of the target image on the print medium in accordance with a predetermined print resolution; and supply the print data to the print performing unit, wherein the print data includes first edge print data and first central print data, the first edge print data being for causing the print performing unit to form a first edge image which is a part of the target image on a first edge area being located at an edge of the print medium along the first direction, the first central print data being for causing the print performing unit to form a first central image which is another part of the target image on a first central area being located at a center of the print medium along the first direction, wherein the first edge print data includes data for causing the print performing unit to perform printing which satisfies following conditions:

(A1) the medium transportation unit sequentially transports the print medium M1 times along the first direction by a first transportation amount, the M1 being an integer equal to or more than 2, and the first transportation amount being less than a standard transportation amount;

(A2) the head driving unit causes the printing head to perform a first type of main-scanning action each time the transportation of the print medium by the first transportation amount is completed;

(A3) in M1 times of the first type of main-scanning actions, each of which is performed each time the transportation of the print medium by the first transportation amount is completed, a number of nozzles of a usage nozzle group is maintained to n among the N, the n being an integer satisfying $1 \leq n < N$, and the usage nozzle group being a group of nozzles that is permitted to be used; and (A4) in the M1 times of the first type of main-scanning actions, the usage nozzle group used in the first type of main-scanning action for an m1-th time is shifted toward an upstream side along the first direction, compared to the usage nozzle group used in the first type of main-scanning action for an (m1−1)-th time, the m1 being each integer satisfying $2 \leq m1 \leq M1$, wherein the first central print data includes data for causing the print performing unit to perform printing which satisfies following conditions:

(B1) the medium transportation unit sequentially transports the print medium M2 times along the first direction by a second transportation amount, the M2 being an integer equal to or more than 2, and the second transportation amount being equal to or greater than the standard transportation amount;

(B2) the head driving unit causes the printing head to perform a second type of main-scanning action each time the transportation of the print medium by the second transportation amount is completed; and (B3) in M2 times of the second type of main-scanning actions, each of which is performed each time the transportation of the print medium by the second transportation amount is completed, the number of nozzles of the usage nozzle group is maintained to the n among the N, wherein the standard transportation amount is a transportation amount which realizes printing in accordance with the predetermined print resolution by a plurality of main-scanning actions, in a state where the print medium is transported by a constant transportation amount, the number of nozzles of the usage nozzle group is maintained to the n among the N, and the usage nozzle group is not shifted.

2. The control device as in claim 1, wherein the first central print data includes data for causing the print performing unit to further perform printing which satisfies following conditions:

(B4) the second transportation amount is equal to the standard transportation amount; and (B5) in the M2 times of the second type of main-scanning actions, the usage nozzle group used in the second type of main-scanning action for an m2-th time is identical to the usage nozzle group used in the second type of main-scanning action for an (m2−1)-th time, the m2 being each integer satisfying $2 \leq m2 \leq M2$.

3. The control device as in claim 2, wherein the first edge area is located at an edge of the print medium on the downstream side along the first direction, the print data further includes second edge print data, the second edge print data being for causing the print performing unit to form a second edge image which is another part of the target image on a second edge area being located at an edge of the print medium at the upstream side along the first direction, and the second edge print data includes data for causing the print performing unit to perform printing which satisfies following conditions:

(C1) the medium transportation unit sequentially transports the print medium M3 times along the first direction by a third transportation amount, the M3 being an integer equal to or more than 2, and the third transportation amount being less than the standard transportation amount;

(C2) the head driving unit causes the printing head to perform a third type of main-scanning action each time the transportation of the print medium by the third transportation amount is completed;

(C3) in M3 times of the third type of main-scanning actions, each of which is performed each time the transportation of the print medium by the third transportation amount is completed, the number of nozzles of the usage nozzle group is maintained to the n among the N; and (C4) in the M3 times of the third type of main-scanning actions, the usage nozzle group used in the third type of main-scanning action for an m3-th time is shifted toward the upstream side along the first direction, compared to the usage nozzle group used in the third type of main-scanning action for an (m3−1)-th time, the m3 being each integer satisfying 2≤m3≤M3.

4. The control device as in claim 1, wherein the first edge area is located at an edge of the print medium on the downstream side along the first direction, the print data further includes second edge print data, the second edge print data being for causing the print performing unit to form a second edge image which is another part of the target image on a second edge area being located at an edge of the print medium at the upstream side along the first direction, and the first central print data includes data for causing the print performing unit to further perform printing which satisfies following conditions:

(B4) the second transportation amount is greater than the standard transportation amount; and (B5) in the M2 times of the second type of main-scanning actions, the usage nozzle group used in the second type of main-scanning action for an m2-th time is shifted to the downstream side along the first direction, compared to the usage nozzle group used in the second type of main-scanning action of an (m2−1)-th time, the m2 being each integer satisfying 2≤m2≤M2, wherein the second edge print data includes data for causing the print performing unit to perform printing which satisfies following conditions:

(C1) the medium transportation unit sequentially transports the print medium in M3 times along the first direction by a third transportation amount, the M3 being an integer equal to or more than 2, and the third transportation amount being less than the standard transportation amount;

(C2) the head driving unit causes the printing head to perform a third type of main-scanning action each time the transportation of the print medium by the third transportation amount is completed;

(C3) in M3 times of the third type of main-scanning actions, each of which is performed each time the transportation of the print medium by the third transportation amount is completed, the number of nozzles of the usage nozzle group is maintained to the n among the N; and (C4) in the M3 times of the third type of main-scanning actions, the usage nozzle group used in the third type of main-scanning action for an m3-th time is shifted toward the upstream side along the first direction, compared to the usage nozzle group used in the third type of main-scanning action for an (m3−1)-th time, the m3 being each integer satisfying 2≤m3≤M3.

5. The control device as in claim 4, wherein the print data further includes second central print data, the second central print data being for causing the print performing unit to form a second central image which is another part of the target image on a second central area being located at the center of the print medium along the first direction, the second central area being located at the downstream side of the first central area along the first direction, and the second central print data includes data for causing the print performing unit to further perform printing which satisfies following conditions:

(D1) the medium transportation unit sequentially transports the print medium M4 times along the first direction by the standard transportation amount, the M4 being an integer equal to or more than 2;

(D2) the head driving unit causes the printing head to perform a fourth type of main-scanning action each time the transportation of the print medium by the standard transportation amount is completed;

(D3) in M4 times of the fourth type of main-scanning actions, each of which is performed each time the transportation of the print medium by the standard transportation amount is completed, the number of nozzles of the usage nozzle group is maintained to the n among the N; and (D4) in the M4 times of the fourth type of main-scanning actions, the usage nozzle group used in the fourth type of main-scanning action for an m4-th time is identical to the usage nozzle group used in the fourth type of main-scanning action for an (m4−1)-th time, the m4 being each integer satisfying 2≤m4≤M4.

6. The control device as in claim 4, wherein the print data further includes third central print data, the third central print data being for causing the print performing unit to form a third central image which is another part of the target image on a third central area being located at the center of the print medium along the first direction, the third central area being located at the upstream side of the first central area along the first direction, and the third central print data includes data for causing the print performing unit to further perform printing which satisfies following conditions:

(E1) the medium transportation unit sequentially transports the print medium M5 times along the first direction by the standard transportation amount, the M5 being an integer equal to or more than 2;

(E2) the head driving unit causes the printing head to perform a fifth type of main-scanning action each time the transportation of the print medium by the standard transportation amount is completed;

(E3) in M5 times of the fifth type of main-scanning actions, each of which is performed each time the transportation of the print medium by the standard transportation amount is completed, the number of nozzles of the usage nozzle group is maintained to the n among the N; and (E4) in the M5 times of the fifth type of main-scanning actions, the usage nozzle group used in the fifth type of main-scanning action for an m5-th time is identical to the usage nozzle group used in the fifth type of main-scanning action for an (m5−1)-th time, the m5 being each integer satisfying 2≤m5≤M5.

7. The control device as in claim 1, wherein the first edge area is located on the downstream side along the first direction on the print medium.

8. The control device as in claim 7, wherein the medium transportation unit comprises:

an upstream side roller that is located at the upstream side of the printing head along the first direction and is for supporting the print medium; and a downstream side roller that is located at the downstream side of the printing head along the first direction and is for supporting the print medium, and the condition (A4) includes a condition in which the usage nozzle group used in the first type of main-scanning action for the m1-th time is shifted toward the upstream side along the first direction, compared to the usage nozzle group used in the first type of main-scanning action for the (m1−1)-th time, after a change has been made from a state where the print medium is not supported by the downstream side roller to a state where the print medium is supported by the downstream side roller.

9. The control device as in claim 1, wherein the first edge area is located at the upstream side along the first direction on the print medium.

10. The control device as in claim 9, wherein the medium transportation unit comprises:

an upstream side roller that is located at the upstream side of the printing head along the first direction and is for supporting the print medium; and a downstream side roller that is located at the downstream side of the printing head along the first direction and is for supporting the print medium, and the condition (A4) includes a condition in which the usage nozzle group used in the first type of main-scanning action for the m1-th time is shifted toward the upstream side along the first direction, compared to the usage nozzle group used in the first type of main-scanning action for the (m1−1)-th time, before a change is made from a state where the print medium is supported by the upstream side roller to a state where the print medium is not supported by the upstream side roller.

11. The control device as in claim 1, wherein the print data is data for causing the print performing unit to form one raster extending linearly along the second direction on the print medium by j times of the main-scanning actions, the j being an integer equal to or more than 1, and the standard transportation amount is represented by n/j×D, where the D is a length between two adjacent dots formed on the print medium along the first direction, and the j is a divisor of the n.

12. The control device as in claim 1, wherein the print data is data for causing the print performing unit to form k rasters within a length of one nozzle pitch along the first direction on the print medium by (k×j) times of the main-scanning actions, the k being an integer equal to or more than 1, and the j being an integer equal to or more than 1, the one nozzle pitch is a distance between two adjacent nozzles along the first direction among the N nozzles, the j is a number of times of the main-scanning actions which are necessary for forming one raster extending linearly along the second direction, the standard transportation amount is represented by (k×X+b)×D, where the D is a length between adjacent two dots formed on the print medium along the first direction, and each of the b and the X is an integer satisfying:

$$-(1/2)\times k<b\leq(1/2)\times k;\text{ and}$$

$$n=(k\times X+b)\times j.$$

13. A non-transitory computer-readable recording medium storing computer-readable instructions for a control device configured to cause a print performing unit to perform printing, wherein the print performing unit comprises:

a printing head comprising N nozzles which align along a first direction, the N being an integer equal to or more than 2;

a medium transportation unit configured to transport a print medium from an upstream side to a downstream side along the first direction; and a head driving unit configured to cause the printing head to perform a main-scanning action, the main-scanning action including an action for causing the printing head to discharge ink toward the print medium while causing the printing head to move along a second direction which is perpendicular to the first direction, the computer-readable instructions, when performed by a processor of the control device, causing the control device to:

obtain image data representing a target image;

create print data using the image data, the print data being for causing the print performing unit to perform printing of the target image on the print medium in accordance with a predetermined print resolution; and supply the print data to the print performing unit, wherein the print data includes first edge print data and first central print data, the first edge print data being for causing the print performing unit to form a first edge image which is a part of the target image on a first edge area being located at an edge of the print medium along the first direction, the first central print data being for causing the print performing unit to form a first central image which is another part of the target image on a first central area being located at a center of the print medium along the first direction, wherein the first edge print data includes data for causing the print performing unit to perform printing which satisfies following conditions:

(A1) the medium transportation unit sequentially transports the print medium M1 times along the first direction by a first transportation amount, the M1 being an integer equal to or more than 2, and the first transportation amount being less than a standard transportation amount;

(A2) the head driving unit causes the printing head to perform a first type of main-scanning action each time the transportation of the print medium by the first transportation amount is completed;

(A3) in M1 times of the first type of main-scanning actions, each of which is performed each time the transportation of the print medium by the first transportation amount is completed, a number of nozzles of a usage nozzle group is maintained to n among the N, the n being an integer satisfying 1≤n<N, and the usage nozzle group being a group of nozzles that is permitted to be used; and (A4) in the M1 times of the first type of main-scanning actions, the usage nozzle group used in the first type of main-scanning action for an m1-th time is shifted toward an upstream side along the first direction, compared to the usage nozzle group used in the first type of main-scanning action for an (m1−1)-th time, the m1 being each integer satisfying 2≤m1≤M1, wherein the first central print data includes data for causing the print performing unit to perform printing which satisfies following conditions:

(B1) the medium transportation unit sequentially transports the print medium M2 times along the first direction by a second transportation amount, the M2 being an integer equal to or more than 2, and the second transportation amount being equal to or greater than the standard transportation amount;

(B2) the head driving unit causes the printing head to perform a second type of main-scanning action each time the transportation of the print medium by the second transportation amount is completed; and (B3) in M2 times of the second type of main-scanning actions, each of which is performed each time the transportation of the print medium by the second transportation amount is completed, the number of nozzles of the usage nozzle group is maintained to the n among the N, wherein the standard transportation amount is a transportation amount which realizes printing in accordance with the predetermined print resolution by a plurality of main-scanning actions, in a state where the print medium is transported by a constant transportation amount, the number of nozzles of the usage nozzle group is maintained to the n among the N, and the usage nozzle group is not shifted.

14. A printer comprising:

a print performing unit comprising:

a printing head comprising N nozzles which align along a first direction, the N being an integer equal to or more than 2;

a medium transportation unit configured to transport a print medium from an upstream side to a downstream side along the first direction; and a head driving unit configured to cause the printing head to perform a main-scanning action, the main-scanning action including an action for causing the printing head to discharge ink toward the print medium while causing the printing head to move along a second direction which is perpendicular to the first direction;

a processor; and a memory storing computer-readable instructions which, when performed by the processor, cause the printer to:

obtain image data representing a target image;

create print data using the image data, the print data being for causing the print performing unit to perform printing of the target image on the print medium in accordance with a predetermined print resolution; and supply the print data to the print performing unit, wherein the print data includes first edge print data and first central print data, the first edge print data being for causing the print performing unit to form a first edge image which is a part of the target image on a first edge area being located at an edge of the print medium along the first direction, the first central print data being for causing the print performing unit to form a first central image which is another part of the target image on a first central area being located at a center of the print medium along the first direction, wherein the first edge print data includes data for causing the print performing unit to perform printing which satisfies following conditions:

(A1) the medium transportation unit sequentially transports the print medium M1 times along the first direction by a first transportation amount, the M1 being an integer equal to or more than 2, and the first transportation amount being less than a standard transportation amount;

(A2) the head driving unit causes the printing head to perform a first type of main-scanning action each time the transportation of the print medium by the first transportation amount is completed;

(A3) in M1 times of the first type of main-scanning actions, each of which is performed each time the transportation of the print medium by the first transportation amount is completed, a number of nozzles of a usage nozzle group is maintained to n among the N, the n being an integer satisfying $1 \leq n < N$, and the usage nozzle group being a group of nozzles that is permitted to be used; and (A4) in the M1 times of the first type of main-scanning actions, the usage nozzle group used in the first type of main-scanning action for an m1-th time is shifted toward an upstream side along the first direction, compared to the usage nozzle group used in the first type of main-scanning action for an (m1−1)-th time, the m1 being each integer satisfying $2 \leq m1 \leq M1$, wherein the first central print data includes data for causing the print performing unit to perform printing which satisfies following conditions:

(B1) the medium transportation unit sequentially transports the print medium M2 times along the first direction by a second transportation amount, the M2 being an integer equal to or more than 2, and the second transportation amount being equal to or greater than the standard transportation amount;

(B2) the head driving unit causes the printing head to perform a second type of main-scanning action each time the transportation of the print medium by the second transportation amount is completed; and (B3) in M2 times of the second type of main-scanning actions, each of which is performed each time the transportation of the print medium by the second transportation amount is completed, the number of nozzles of the usage nozzle group is maintained to the n among the N, wherein the standard transportation amount is a transportation amount which realizes printing in accordance with the predetermined print resolution by a plurality of main-scanning actions, in a state where the print medium is transported by a constant transportation amount, the number of nozzles of the usage nozzle group is maintained to the n among the N, and the usage nozzle group is not shifted.

* * * * *